US005843631A

United States Patent [19]

Mihayashi et al.

[11] Patent Number: 5,843,631

[45] Date of Patent: Dec. 1, 1998

[54] SILVER HALIDE PHOTOGRAPHIC MATERIAL

[75] Inventors: Keiji Mihayashi; Masatoshi Nakanishi; Akihiro Ikeyama; Masayoshi Toyoda, all of Kanagawa, Japan

[73] Assignee: Fuji Photo Film Co., Ltd., Kanagawa, Japan

[21] Appl. No.: 859,078

[22] Filed: May 20, 1997

[30] Foreign Application Priority Data

Jun. 4, 1996 [JP] Japan ..... 8-141711

[51] Int. Cl.[6] ..... G03C 1/76

[52] U.S. Cl. ..... 430/523; 430/140; 430/523; 430/536; 430/961

[58] Field of Search ..... 430/523, 531, 430/536, 140, 961, 633, 637

[56] References Cited

U.S. PATENT DOCUMENTS

| | | | |
|---|---|---|---|
| 4,021,241 | 5/1977 | Young | 430/220 |
| 5,432,050 | 7/1995 | James et al. | 430/140 |
| 5,753,426 | 5/1998 | Nair et al. | 430/140 |

FOREIGN PATENT DOCUMENTS

| | | | |
|---|---|---|---|
| A-395107 | 10/1990 | European Pat. Off. . | |
| 58-33541 | 7/1983 | Japan . | |
| 7-181612 | 7/1995 | Japan | 430/961 |

*Primary Examiner*—Richard L. Schilling
*Attorney, Agent, or Firm*—Sughrue, Mion, Zinn, Macpeak & Seas, PLLC

[57] ABSTRACT

A silver halide photographic material is described, which comprises a support having provided thereon at least one light-sensitive silver halide emulsion layer and a magnetic recording layer in backing layers on the side of the support opposite to the side on which the silver halide emulsion layer is provided, wherein the layer on the farthest side from the support of the backing layers contains a binder and a sliding agent, and the weight ratio of the sliding agent/binder is from 1 to $1\times10^4$.

8 Claims, No Drawings

SILVER HALIDE PHOTOGRAPHIC MATERIAL

FIELD OF THE INVENTION

The present invention relates to a silver halide photographic material having a magnetic recording function comprising a support having provided thereon a magnetic recording layer as a backing layer, which is improved in a sliding property, prevented from the adhesion of dusts and chips of the processed material, etc., and reduced in faults and errors at input and output head parts of magnetic information.

BACKGROUND OF THE INVENTION

In recent years, a lot of techniques have been disclosed with respect to a silver halide photographic material having a magnetic recording layer as a backing layer. Further, such photographic materials having a magnetic recording layer have been recently introduced into the market.

It has become possible to incorporate various kinds of information which were conventionally difficult into a photographic material by providing a photographic material with a magnetic recording layer, and the convenience thereof has been recognized by lab traders and users.

However, there are fears of arising of problems such as the occurrence of spot failure due to the adhesion of dusts and chips of a processed material and the occurrence of input and output errors of magnetic information to and from a magnetic recording layer, for example, the occurrence of the jitters of magnetic recording with a camera, etc. or the occurrence of read errors or faults due to the contamination of a magnetic head of a device which reads out magnetic information from a photographic material, and it was supposed to be necessary to adopt perfect countermeasures before these problems had developed.

As sliding agents concerning the present invention, there are disclosures in U.S. Pat. Nos. 4,275,146 and 3,933,516, British Patent 927,446, JP-B-58-33541 (the term "JP-B" as used herein means an "examined Japanese patent publication") and EP-A-395107.

Further, various binders are disclosed, for example, in JP-A-4-219569 (the term "JP-A" as used herein means an "unexamined published Japanese patent application") and hydroxyalkyl cellulose is disclosed, for example, in U.S. Pat. No. 4,021,241.

However, there are no descriptions in these cited literature with respect to the usage of the specific constitution of the present invention and no descriptions suggesting or capable of presuming the effect of the present invention.

SUMMARY OF THE INVENTION

Accordingly, an object of the present invention is to provide a silver halide photographic material which is improved in a sliding property of a back surface, prevented from the adhesion of dusts and chips of the processed material, etc., and reduced in input and output errors of magnetic information and read errors and faults due to the contamination of a magnetic head part.

The above object of the present invention has been attained by the following means: that is, (1) A silver halide photographic material comprising a support having provided thereon at least one light-sensitive silver halide emulsion layer and a magnetic recording layer in backing layers on the side of the support opposite to the side on which the silver halide emulsion layer is provided, wherein the layer on the farthest side from the support of said backing layers contains a binder and a sliding agent, and the weight ratio of the sliding agent/binder is from 1 to $1\times10^4$.

(2) The silver halide photographic material as described in (1), wherein said sliding agent is a higher fatty acid or a derivative thereof and is contained in an amount of 1 mg/m$^2$ or more.

(3) The silver halide photographic material as described in (1) or (2), wherein said binder is hydroxyalkyl cellulose.

DETAILED DESCRIPTION OF THE INVENTION

The present invention will be described in detail below.

In the first place, the sliding agent contained in the layer farthest from the support (the uppermost layer) constituting backing layers according to the present invention is explained below.

Any known sliding agents can be used in the present invention. Known sliding agents can be broadly classified to silicone compounds and higher fatty acids or derivatives thereof. The latter higher fatty acids or derivatives thereof are preferably used to solve the problems according to the present invention.

Examples of higher fatty acids or derivatives thereof which can be used in the present invention include, for example, higher fatty acid amides as disclosed in U.S. Pat. No. 4,275,146, higher fatty acid esters (esters of a fatty acid having from 10 to 24 carbon atoms and an alcohol having from 10 to 24 carbon atoms) as disclosed in JP-B-58-33541, British Patent 927,446 and JP-A-55-126238 and JP-A-58-90633, metal salts of higher fatty acids as disclosed in U.S. Pat. No. 3,933,516, esters of a straight chain higher fatty acid and a straight chain higher alcohol as disclosed in JP-A-58-50534, and esters of a higher fatty acid containing a branched alkyl group and a higher alcohol as disclosed in EP-A-395107. Natural fat and oil waxes and oils, e.g., a montanic acid ester, a carnauba wax, a beeswax, etc., can also be used. Further, higher alcohols, higher fatty acids and derivatives thereof can also be used. The use of at least one kind of ester of a higher fatty acid and a higher alcohol is preferred in the present invention. Representative examples of such compounds are shown below.

| | |
|---|---|
| (1) | $(n)C_{15}H_{31}COOC_{16}H_{33}(n)$ |
| (2) | $(n)C_{17}H_{35}COOC_{17}H_{37}(n)$ |
| (3) | $(n)C_{17}H_{35}COOC_{32}H_{65}(n)$ |
| (4) | $(n)C_{21}H_{43}COOC_{22}H_{45}(n)$ |
| (5) | $(n)C_{15}H_{31}COOC_{40}H_{81}(n)$ |
| (6) | $(iso)C_{17}H_{35}COOC_{36}H_{73}(iso)$ |
| (7) | $(C_{15}H_{31}COOCH_2)_3-CCH_3$ |
| (8) | $\begin{array}{l} C_{15}H_{31}COO-CH_2 \\ \quad\quad\quad\quad\quad\quad\ \ \vert \\ C_{15}H_{31}COO-CH \\ \quad\quad\quad\quad\quad\quad\ \ \vert \\ C_{15}H_{31}COO-CH_2 \end{array}$ |
| (9) | $(n)C_{18}H_{37}OOC-(CH_2)_4-COOC_{18}H_{37}(n)$ |
| (10) | $(n)C_6H_{13}CHOHC_{10}H_{20}COOC_{40}H_{81}(n)$ |
| (11) | $(n)C_{17}H_{35}COOC_{40}H_{81}(n)$ |
| (12) | $(n)C_{50}H_{101}COOC_{50}H_{101}(n)$ |
| (13) | $(n)C_{23}H_{47}COOC_{32}H_{65}(n)$ |
| (14) | $(n)C_{17}H_{35}COONa$ |
| (15) | $((n)C_{21}H_{43}COO)_2Ca$ |
| (16) | $(n)C_{17}H_{35}CONH_2$ |

-continued

| | |
|---|---|
| (17) | $(n)C_{17}H_{35}CON(C_{12}H_{25}(n))_2$ |
| (18) | $(n)C_{23}H_{47}CONHC_{12}H_{25}(n)$ |
| (19) | $((n)C_{16}H_{33})NCH_2CH_2CH_2COOH$ |
| (20) | $(n)C_{50}H_{101}COOH$ |

Silicone compounds are not particularly limited and those commercially available or obtainable by synthesis can be used. Polyorganosiloxanes are preferably used as a silicone compound. There is no particular limitation on the molecular weight thereof, generally from 1,000 to 2,000,000. Synthesis methods of these compounds are disclosed in detail in German Patent 1,938,959, U.S. Pat. No. 2,694,637, 3,042,522, JP-B-51-33600, JP-B-52-22040, JP-A-59-31543, JP-A-62-203152, JP-A-62-269139, JP-A-60-54015, JP-A-2-301750, JP-A-2-115836, JP-B-3-2285 and JP-A-6-102615.

Silicone compounds for use in the present invention can easily be obtained as commercially available products having various structures from, e.g., Dow Corning, U.S.A., BYK Chemie, Germany, Shin-Etsu Chemical Co., Ltd., Toshiba Silicone Co., Ltd., Toray Dow Corning Silicone Co., Ltd., Nippon Unicar Co., Ltd., and Chisso Corporation. In addition, derivatives can be easily produced by an ordinary chemical reaction using these commercially available silicone products as raw materials. Deriving reactions are described in various literature and publications, for example, E.G. Rochow, *An Introduction to the Chemistry of the Silicons* (translated by Central Institution, Shin-Etsu Chemical Co., Ltd., published by Maruzen) and others.

The binders contained in the layer farthest from the support (the uppermost layer) constituting backing layers according to the present invention is explained below.

Natural polymers including various kinds of resins, polymers and gelatins disclosed, for example, in JP-A-4-219569 and mixtures of these can be used in the present invention. Cellulose derivatives, e.g., diacetyl cellulose, hydroxyalkyl cellulose, etc., are preferred above all. Hydroxyalkyl cellulose is particularly preferably used.

The hydroxyalkyl cellulose for use in the present invention is a cellulose derivative modified with an alkyl group having a hydroxyl group and having from 2 to 8 carbon atoms, preferably a cellulose derivative etherified with an alkyl group having a hydroxyl group and having from 2 to 6 carbon atoms, and particularly preferably a hydroxyethyl cellulose derivative and a hydroxypropyl cellulose derivative.

Other hydroxyl groups of these cellulose derivatives may have a substituent. For example, a cellulose derivative modified with an alkyl group (an alkyl group having from 1 to 8 carbon atoms, e.g., methyl, ethyl, butyl), an aryl group (e.g., phenyl), an acyl group (an acyl group having from 2 to 8 carbon atoms, e.g., acetyl, propionyl), a polyoxyalkylene group (e.g., polyoxyethylene, polyoxypropylene) can be cited.

There is no particular limitation on the molecular weight of the hydroxyalkyl cellulose for use in the present invention, but is preferably from 3,000 to 3,000,000, and particularly preferably from 10,000 to 1,500,000.

Hydroxyalkyl cellulose disclosed, for example, in U.S. Pat. Nos. 4,021,241, 3,266,894, 3,615,422, 3,832,173, British Patent 1,435,145, German Patent 2,116,780, JP-B-45-18435, JP-A-63-153538, JP-A-1-221281, JP-A-1-255858 and JP-A-2-948 can be preferably used in the present invention.

Hydroxyalkyl cellulose for use in the present invention can be easily synthesized, in general, by the reaction of cellulose and alkylene oxide and disclosed in detail, for example, in U.S. Pat. No. 3,392,022 and JP-B-49-17367. They are easily obtainable as commercially available products, for example, hydroxyethyl cellulose is available from Hercules Incorporated, U.S.A. and Daicel Chemical Industries Ltd., hydroxypropyl cellulose from Nippon Soda Co., Ltd. and Shin-Etsu Chemical Co., Ltd., and ethylhydroxyethyl cellulose from Hercules Incorporated, U.S.A. In addition, derivatives can be easily produced by an ordinary chemical reaction using these commercially available hydroxyalkyl cellulose as raw materials. With respect to reactions for producing derivatives, methods described, for example, in Takayuki Ohtsu and Masayoshi Kinoshita, *Kobunshi Gosei no Jikken-ho* (*Experimental Methods of High Molecular Compounds*), pages 380 to 382, Kagaku Dojin, (1972), and *Kobunshi Kino Zairvo Series* 2, *Kobunshi no Gosei to Hanno* (*High Molecular Functional Material Series* 2, *Syntheses and Reactions of High Molecular Compounds*), compiled by High Molecular Compound Institute, pages 507 to 512, Kyoritsu Shuppan, (1991) can be preferably used in the present invention.

Specific examples of hydroxyalkyl cellulose for use in the present invention are shown below, but the present invention is not limited to these compounds.

Numerals in parentheses indicate average numbers of corresponding functional groups (units) introduced per one pyranose ring forming the cellulose structure.

| | |
|---|---|
| HAC-1 | 2-Hydroxyethyl cellulose (hydroxyethyl group: 1.0) |
| HAC-2 | 2-Hydroxyethyl cellulose (hydroxyethyl group: 2.0) |
| HAC-3 | 2-Hydroxyethyl cellulose (hydroxyethyl group: 3.0) |
| HAC-4 | 2-Hydroxypropyl cellulose (hydroxypropyl group: 1.5) |
| HAC-5 | 2-Hydroxypropyl cellulose (hydroxypropyl group: 2.0) |
| HAC-6 | 2-Hydroxypropyl cellulose (hydroxypropyl group: 3.3) |
| HAC-7 | 2-Hydroxyethylethyl cellulose (hydroxyethyl group: 1.25, ethyl group: 1.0) |
| HAC-8 | 2-Hydroxypropylmethyl cellulose (hydroxypropyl group: 1.0, methyl group: 1.2) |
| HAC-9 | 2-Hydroxybutyl cellulose (hydroxybutyl group: 0.15) |
| HAC-10 | 2-(2-Hydroxyethoxyethyl) cellulose (2-hydroxyethoxyethyl group: 1.7) |
| HAC-11 | 2-Hydroxyethyl-4-hydroxybutylmethyl cellulose (2-hydroxyethyl group: 1.28, 4-hydroxybutyl group: 0.06, methyl group: 0.99) |
| HAC-12 | 2-Hydroxyethyl cellulose acetate (2-hydroxyethyl group: 2.55, acetyl group: 0.84) |
| HAC-13 | 2-Hydroxypropyl-2-hydroxyethyl cellulose (2-hydroxyethyl group: 1.1, 2-hydroxypropyl group: 1.55) |

The present invention is characterized in that the weight ratio of a sliding agent/binder is retained within the range of from 1 to $1\times10^4$ by adding a sliding agent to the uppermost layer constituting backing layers.

The object of the present invention can be attained by maintaining the weight ratio of the sliding agent/binder within the above range. The weight ratio is preferably from 3 to 1,000, particularly preferably from 5 to 500.

As described above, as a sliding agent, the use of at least one kind of ester of a higher fatty acid and a higher alcohol is particularly preferred in the present invention. The coating weight of the sliding agent to the uppermost layer is 1 mg/m$^2$ or more and the upper limit is 50 mg/m$^2$, preferably 3 mg/m$^2$ or more and more preferably 5 mg/m$^2$ or more. If it is less than 1 mg/m$^2$, a sufficient sliding property cannot be obtained and it is difficult to achieve the object of the present invention. If it exceeds 50 mg/m$^2$, production trouble occurs and is not preferred.

Moreover, the coating weight of the binder to the uppermost layer is 50 mg/m$^2$ or less and the lower limit is $1\times10^{-3}$ mg/m$^2$, preferably 30 mg/m$^2$ or less and particularly preferably from $1\times10^{-2}$ mg/m$^2$ to 20 mg/m$^2$. As described above, as a binder, the use of hydroxyalkyl cellulose is preferred. If the coating weight of the binder to the uppermost layer is less than $1\times10^{-3}$ mg/m$^2$, the coated surface state is sometimes deteriorated, which causes adhesion failure. While when it exceeds 50 mg/m$^2$, the production load becomes large and economically unadvantageous, in addition, it becomes difficult to invest the layer with a sufficient sliding property.

The coating weight of the binder can be determined arbitrarily within the above range so that the weight ratio of the sliding agent/binder is within the above-described range with the coating weight of the sliding agent being within the above range.

A good sliding property can be obtained and the object of the present invention can be superbly achieved by obtaining the above-described coating weights, in particular, with obtaining the above sliding agent/binder weight ratio by coating the prescribed weight of the sliding agent per unit area and reducing the binder amount. A good sliding property means, in terms of a physical property value, for example, a dynamic friction coefficient of from 0.01 to 0.12, preferably from 0.01 to 0.10. This dynamic friction coefficient is a value measured using a stainless steel ball having a diameter of 5 mm with a load of 100 g at a transporting speed of 60 cm/min (25° C., 60% RH).

Backing layers on the side of the support opposite to the side on which photographic constitutional layers are provided are described below.

The above photographic constitutional layers comprise the layers of the constitution comprising at least one light-sensitive silver halide emulsion layer. Backing layers according to the present invention comprise light-insensitive layers not including a light-sensitive silver halide emulsion layer.

Light-insensitive layers constituting backing layers comprise the following layers required of the photographic material, provided on an undercoat layer on a support, for example, an antihalation layer for preventing halation, an antistatic layer for preventing electrostatic charge, a magnetic recording layer for recording various information, a sliding layer for imparting a sliding property to the photographic material, interlayers for separating these layers or a protective layer. The constitution of backing layers in general photographic materials, in particular, the constitution of backing layers in a photographic material for photographing, comprises an antistatic layer for preventing electrostatic charge attributable to the support, then a magnetic recording layer, in the order from the support side, and a sliding layer farthest from the support, in general, based on the characteristics invested to the layers. When an antihalation layer is provided, the position thereof is adjacent to the antistatic layer and either nearest to the support or farther than the antistatic layer. An interlayer may be provided between these layers. A sliding layer is provided on the farthest side from the support, in general, but in some cases a protective layer is provided for protecting backing layers. The protective layer has the film thickness of 1.0 $\mu$m or less, preferably 0.5 $\mu$m or less, and more preferably 0.3 $\mu$m or less. However, the provision of the protective layer is not preferred for effectively manifesting the sliding property of the sliding layer.

In the present invention, the layer provided on the farthest side from the support, which constitutes backing layers, is a sliding layer.

A magnetic recording layer for use in the present invention is explained below.

A magnetic recording layer for use in the present invention is a layer coated on a support with an aqueous or organic solvent based coating solution comprising magnetic particles dispersed in a binder.

Examples of the magnetic particles for use in the present invention include ferromagnetic iron oxide such as $\gamma$-$Fe_2O_3$, Co-adhered $\gamma$-$Fe_2O_3$, Co-adhered magnetite, Co-containing magnetite, ferromagnetic chromium dioxide, ferromagnetic metal, ferromagnetic alloy, hexagonal system Ba ferrite, Sr ferrite, Pb ferrite, and Ca ferrite. Co-adhered ferro-magnetic iron oxide such as Co-adhered $\gamma$-$Fe_2O_3$ is preferred. The shape of the magnetic particle may be any of an acicular shape, a rice grain shape, a spherical shape, a cubic shape, or a plate-like shape. The specific surface area ($S_{BET}$) is preferably 20 m$^2$/g or more, and particularly preferably 30 m$^2$/g or more. The saturation magnetization ($\sigma_s$) of the ferromagnetic substance is preferably from $3.0\times10^4$ to $3.0\times10^5$ A/m and particularly preferably from $4.0\times10^4$ to $2.5\times10^5$ A/m. The ferromagnetic particles may be surface treated with silica and/or alumina and organic materials. Further, the surface of the magnetic particles may be treated with a silane coupling agent or a titanium coupling agent as disclosed in JP-A-6-161032. In addition, the magnetic particles the surfaces of which are covered with inorganic or organic substance as disclosed in JP-A-4-259911 and JP-A-5-81652 can also be used.

The binders which can be used for the magnetic particles includes thermoplastic resins, thermosetting resins, radiation curable resins, reactive type resins, acid-, alkali- or biodegradable polymers, natural polymers (e.g., cellulose derivatives, saccharide derivatives), and mixtures thereof disclosed in JP-A-4-219569. The above described resins have a Tg of from −40° C. to 300° C., and a weight average molecular weight of from 2,000 to 1,000,000. Examples of the binders include vinyl based copolymers, cellulose derivatives such as cellulose diacetate, cellulose triacetate, cellulose acetate propionate, cellulose acetate butyrate and cellulose tripropionate, acrylic resins, and polyvinyl acetal resins. Gelatin is also preferably used. Cellulose di(tri) acetate is particularly preferred. The binder can be subjected to curing treatment by adding epoxy based, aziridine based or isocyanate based crosslinking agent. Examples of the isocyanate based crosslinking agents include isocyanates such as tolylenediisocyanate, 4,4'-diphenylmethanediisocyanate, hexamethylenediisocyanate and xylenediisocyanate, reaction products of these isocyanates with polyalcohols (e.g., a reaction product of 3 mol of tolylenediisocyanate with 1 mol of trimethylolpropane), and polyisocyanate formed by condensation of these isocyanates, and they are disclosed in JP-A-6-59357.

The above magnetic substances are dispersed in the above-described binder preferably using, as disclosed in JP-A-6-35092, a kneader, a pin type mill, and an annular type mill, and the combined use thereof is also preferred. The dispersants disclosed in JP-A-5-88283 or other known dispersants can be used. The thickness of a magnetic recording layer is from 0.1 $\mu$m to 10 $\mu$m, preferably from 0.2 $\mu$m to 5 $\mu$m, and more preferably from 0.3 $\mu$m to 3 $\mu$m. The weight ratio of the magnetic particles to the binder is preferably from 0.5/100 to 60/100, and more preferably from 1/100 to 30/100. The coating amount of the magnetic particles is from 0.005 to 3 g/m$^2$, preferably from 0.01 to 2 g/m$^2$ , and more preferably from 0.02 to 0.5 g/m$^2$. Transmission yellow density of a magnetic recording layer is preferably from 0.01 to 0.50, more preferably from 0.03 to 0.20, and particularly preferably from 0.04 to 0.15. A magnetic recording layer can be provided on the back surface of a photographic support entirely or in stripe by coating or printing. Coating of a magnetic recording layer can be carried out by means of air doctor coating, blade coating, air knife coating, squeeze coating, impregnation coating, reverse-roll coating, transfer-roll coating, gravure coating, kiss coating, cast coating, spray coating, dip coating, bar coating, or extrusion coating, and the coating solution disclosed in JP-A-5-341436 is preferably used.

A magnetic recording layer may be provided with functions of lubrication improvement, curling adjustment, antistatic property, adhesion prevention and head abrasion, or another functional layer having these functions may be provided, and at least one kind or more of the particles are preferably abrasives of aspheric inorganic particles having Mohs' hardness of 5 or more. The composition of the aspheric inorganic particle is preferably an oxide such as aluminum oxide, chromium oxide, silicon dioxide, titanium dioxide, etc., a carbide such as silicon carbide and titanium carbide, and fine particles such as diamond. The surface of these abrasives may be treated with a silane coupling agent or a titanium coupling agent. These particles may be added to a magnetic recording layer, or may be overcoated on a magnetic recording layer (e.g., a lubricating layer). The above described binders can be used at this time, preferably the same binders as the binder of the magnetic recording layer are used. Photographic materials having magnetic recording layers are disclosed in U.S. Pat. Nos. 5,336,589, 5,250,404, 5,229,259, 5,215,874 and EP-A-466130.

The photographic material of the present invention can comprise at least one light-sensitive layer on a support. In a typical embodiment, the silver halide photographic material of the present invention comprises at least one light-sensitive layer consisting of a plurality of silver halide emulsion layers having substantially the same spectral sensitivity but different degrees of sensitivity on a support. In a color photographic material, the light-sensitive layer is a unit light-sensitive layer having a spectral sensitivity to any of blue light, green light and red light. In a multilayer silver halide color photographic material, these unit light-sensitive layers are generally arranged in the order of red-sensitive layer, green-sensitive layer and blue-sensitive layer from the support side. However, the order of arrangement can be reversed depending on the purpose, alternatively, the light-sensitive layers may be arranged in such a way that a layer having a different spectral sensitivity is interposed between layers having the same spectral sensitivity. Light-insensitive layers may be provided between the above-described silver halide light-sensitive layers, and on the uppermost layer and beneath the lowermost layer of the silver halide light-sensitive layers. These light-insensitive layers may contain couplers, DIR compounds and color mixing preventives described below. As the plurality of silver halide emulsion layers constituting each unit light-sensitive layer, a two-layer structure of a high sensitivity emulsion layer and a low sensitivity emulsion layer can be preferably used with the emulsion layers being arranged so as to decrease in sensitivity toward a support in turn as disclosed in German Patent 1,121,470 and British Patent 923,045. In addition, a low sensitivity emulsion layer may be provided farther from the support and a high sensitivity emulsion layer may be provided nearer to the support as disclosed in JP-A-57-112751, JP-A-62-200350, JP-A-62-206541 and JP-A-62-206543.

In one specific example, a low sensitivity blue-sensitive layer (BL)/a high sensitivity blue-sensitive layer (BH)/a high sensitivity green-sensitive layer (GH)/a low sensitivity green-sensitive layer (GL)/a high sensitivity red-sensitive layer (RH)/a low sensitivity red-sensitive layer (RL), or BH/BL/GL/GH/RH/RL, or BH/BL/GH/GL/RL/RH can be arranged in this order from the side farthest from the support.

A blue-sensitive layer/GH/RH/GL/RL can be arranged in this order from the side farthest from the support as disclosed in JP-B-55-34932. Further, a blue-sensitive layer/GL/RL/GH/RH can be arranged in this order from the side farthest from the support as disclosed in JP-A-56-25738 and JP-A-62-63936.

Further, useful arrangements include the arrangement in which there are three layers having different degrees of sensitivities with the sensitivity being lower towards the support such that the upper layer is a silver halide emulsion layer having the highest sensitivity, the middle layer is a silver halide emulsion layer having a lower sensitivity than that of the upper layer, and the lower layer is a silver halide emulsion layer having a lower sensitivity than that of the middle layer, as disclosed in JP-B-49-15495. In the case of the structure of this type comprising three layers having different degrees of sensitivity, the layers in the unit layer of the same spectral sensitivity may be arranged in the order of a middle sensitivity emulsion layer/a high sensitivity emulsion layer/a low sensitivity emulsion layer, from the side farthest from the support, as disclosed in JP-A-59-202464.

Alternatively, the layers can be arranged in the order of a high sensitivity emulsion layer/a low sensitivity emulsion layer/a middle sensitivity emulsion layer, or a low sensitivity emulsion layer/a middle sensitivity emulsion layer/a high sensitivity emulsion layer. Moreover, the arrangement may be varied as indicated above in the case where there are four or more layers.

In a multilayer color photographic material, a donor layer (CL) for an interlayer effect having a different spectral sensitivity distribution from a main light-sensitive layer such as BL, GL and RL may preferably be provided adjacent or close to the main light-sensitive layer for improving color reproducibility, as disclosed in U.S. Pat. Nos. 4,663,271, 4,705,744, 4,707,436, JP-A-62-160448 and JP-A-63-89850.

The silver halides preferably used in the present invention are silver iodobromide, silver iodochloride or silver iodochlorobromide containing about 30 mol% or less of silver iodide, and particularly preferably used are silver iodobromide or silver iodochlorobromide containing from about 2 mol% to about 10 mol% of silver iodide.

Silver halide grains in a photographic emulsion may have a regular crystal form such as a cubic, octahedral or tetradecahedral form, an irregular crystal form such as a spherical or plate-like form, a form which has crystal defects such as twin crystal planes, or a form which is a composite of these forms.

The silver halide grains may be a fine grain having a grain size of about 0.2 $\mu$m or less, or large size grains having a projected area diameter of up to about 10 $\mu$m, and the emulsion may be a polydisperse emulsion or a monodisperse emulsion.

The term "equivalent-circle diameter" as used hereinafter means a diameter of a circle having the same area as the projected area of a grain. The term "equivalent-sphere diameter" as used hereinafter means a diameter of a sphere having the same volume as the volume of a grain.

The silver halide photographic emulsions for use in the present invention can be prepared using the methods disclosed, for example, in *Research Disclosure* (hereinafter abbreviated to RD), No. 17643 (December, 1978), pages 22 and 23, "I. Emulsion Preparation and Types", RD, No. 18716 (November, 1979), page 648, RD, No. 307105 (November, 1989), pages 863 to 865, P. Glafkides, *Chimie et Physique Photographique*, Paul Montel (1967), G.F. Duffin, *Photographic Emulsion Chemistry*, Focal Press (1966), and V.L. Zelikman et al., *Making and Coating Photographic Emulsion*, Focal Press (1964).

The monodisperse emulsions disclosed in U.S. Pat. Nos. 3,574,628, 3,655,394 and British Patent 1,413,748 are also preferred.

Further, tabular grains having an aspect ratio of about 3 or more can also be used in the present invention. Tabular grains can be easily prepared according to the methods disclosed, for example, in Gutoff, *Photographic Science and Engineering*, Vol. 14, pages 248 to 257 (1970), U.S. Pat. Nos. 4,434,226, 4,414,310, 4,433,048, 4,439,520 and British Patent 2,112,157.

The crystal structure may be uniform, or the interior and exterior parts of the grains may be comprised of different halogen compositions, or the grains may have a layered structure. Silver halides which have different compositions may be joined with an epitaxial junction or may be joined with compounds other than a silver halide, such as silver thiocyanate or lead oxide. Further, mixtures of grains which have various crystal forms may also be used.

The above-described emulsions may be of the superficial latent image type wherein the latent image is primarily formed on the surface., or of the internal latent image type wherein the latent image is formed within the grains, or of the type wherein the latent image is formed both at the surface and within the grains, but a negative type emulsion is essential. Of the internal latent image types, the emulsion may be a core/shell type internal latent image type emulsion as disclosed in JP-A-63-264740, and a method for preparation of such a core/shell type internal latent image type emulsion is disclosed in JP-A-59-133542. The thickness of the shell of this emulsion varies depending on the development process, but is preferably from 3 to 40 nm, and particularly preferably from 5 to 20 nm.

The silver halide emulsion for use in the present invention is usually subjected to physical ripening, chemical ripening and spectral sensitization. Additives for use in such processes are disclosed in RD, No. 17643, RD, No. 18716, and RD, No. 307105, and the locations of these disclosures are summarized in a table below.

In the photographic material of the present invention, two or more different types of emulsions which are different in terms of at least one of the characteristics of grain size, grain size distribution, halogen composition, the form of the grains, or light sensitivity of the light-sensitive silver halide emulsion can be used in admixture in the same layer.

It is preferred to use the silver halide grains having a fogged grain surface as disclosed in U.S. Pat. No. 4,082,553, the silver halide grains having a fogged grain interior as disclosed in U.S. Pat. Nos. 4,626,498 and JP-A-59-214852, or colloidal silver in light-sensitive silver halide emulsion layers and/or substantially light-insensitive hydrophilic colloid layers. Silver halide grains having a fogged grain interior or surface are silver halide grains which can be developed uniformly (not imagewise) irrespective of whether these grains are in an unexposed part or an exposed part of the photographic material, and methods for the preparation thereof are disclosed in U.S. Pat. Nos. 4,626,498 and JP-A-59-214852. The silver halide which forms the internal nuclei of a core/shell type silver halide grains having a fogged grain interior may have different halogen compositions. The silver halide having a fogged grain interior or surface may be any of silver chloride, silver chlorobromide, silver iodobromide, or silver chloroiodobromide. The average grain size of these fogged silver halide grains is preferably from 0.01 to 0.75 $\mu$m, and particularly preferably from 0.05 to 0.6 $\mu$m. Further, the form of the grains may be regular grains and may be a polydisperse emulsion, but a monodisperse emulsion (at least 95% of which have a grain size within ±40% of the average grain size in terms of the weight or number of silver halide grains) is preferred.

The use of light-insensitive fine grained silver halides is preferred in a multilayer color photographic material. Light-insensitive fine grained silver halides are fine grained silver halides which are not sensitive to light upon imagewise exposure for obtaining color images and which do not substantially undergo development during development processing, and they are preferably not pre-fogged. Fine grained silver halide has a silver bromide content of from 0 to 100 mol%, and may contain silver chloride and/or silver iodide, if necessary. Fine grained silver halides which have a silver iodide content of from 0.5 to 10 mol% are preferred. The average grain size of fine grained silver halide (the average value of the diameters of the circles equivalent to the projected areas) is preferably from 0.01 to 0.5 $\mu$m, more preferably from 0.02 to 0.2 $\mu$m.

Fine grained silver halide can be prepared by the same methods as the preparation of generally used light-sensitive silver halides. In the preparation of fine grained silver halide, the surface of silver halide grains does not need to be optically sensitized and also does not need to be spectrally sensitized. However, it is preferred to previously include known stabilizers such as triazole based, azaindene based, benzothiazolium based, or mercapto based compounds, or zinc compounds in fine grained silver halide before addition to the coating solution. Colloidal silver can be included in the layer containing fine grained silver halide grains.

The coating weight of silver in the photographic material of the present invention is preferably 6.0 g/m$^2$ or less, and most preferably 4.5 g/m$^2$ or less.

Photographic additives which can be used in the present invention are disclosed in RD and the locations related thereto are indicated in the table below.

| Type of Additives | RD 17643 | RD 18716 | RD 307105 |
|---|---|---|---|
| 1. Chemical Sensitizers | page 23 | page 648, right column | page 866 |
| 2. Sensitivity Increasing Agents | — | page 648, right column | — |
| 3. Spectral Sensitizers and Supersensitizers | pages 23–24 | page 648, right column to page 649, right column | pages 866–868 |

-continued

| Type of Additives | RD 17643 | RD 18716 | RD 307105 |
|---|---|---|---|
| 4. Brightening Agents | page 24 | page 647, right column | page 868 |
| 5. Light Absorbers, Filter Dyes, and Ultraviolet Absorbers | pages 25–26 | page 649, right column to page 650, left column | page 873 |
| 6. Binders | page 26 | page 651, left column | pages 873–874 |
| 7. Plasticizers and Lubricants | page 27 | page 650, right column | page 876 |
| 8. Coating Aids and Surfactants | pages 26–27 | page 650, right column | pages 875–876 |
| 9. Antistatic Agents | page 27 | page 650, right column | pages 876–877 |
| 10. Matting Agents | — | — | pages 878–879 |

Various dye-forming couplers can be used in the color photographic material of the present invention, and the following couplers are particularly preferred.

Yellow Couplers

The couplers represented by formula (I) or (II) disclosed in EP-A-502424; the couplers represented by formula (1) or (2) disclosed in EP-A-513496 (in particular, Y-28 on page 18); the couplers represented by formula (I) disclosed in claim 1 of EP-A-568037; the couplers represented by formula (I), lines 45 to 55, column 1 of U.S. Pat. No. 5,066,576; the couplers represented by formula (I), paragraph 0008 of JP-A-4-274425; the couplers disclosed in claim 1 on page 40 of EP-A-498381 (in particular, D-35 on page 18); the couplers represented by formula (Y) on page 4 of EP-A-447969 (in particular, Y-1 (page 17) and Y-54 (page 41)); and the couplers represented by any of formulae (II) to (IV), lines 36 to 58, column 7 of U.S. Pat. No. 4,476,219 (in particular, II-17 and II-19 (column 17), and II-24 (column 19)).

Magenta Couplers

L-57 (page 11, right lower column), L-68 (page 12, right lower column), and L-77 (page 13, right lower column) of JP-A-3-39737; [A-4]-63 (page 134), and [A-4]-73 and [A-4]-75 (page 139) of EP-A-456257; M-4 and M-6 (page 26) and M-7 (page 27) of EP-A-486965; M-45 (page 19) of EP-A-571959; (M-1) (page 6) of JP-A-5-204106; and M-22, paragraph 0237 of JP-A-4-362631.

Cyan Couplers

CX-1, CX-3, CX-4, CX-5, CX-11, CX-12, CX-14 and CX-15 (pages 14 to 16) of JP-A-4-204843; C-7 and C-10 (page 35), C-34 and C-35 (page 37), and (I-1) and (I-17) (pages 42 and 43) of JP-A-4-43345; and the couplers represented by formula (Ia) or (Ib) disclosed in claim 1 of JP-A-6-67385.

Polymer Couplers

P-1 and P-5 (page 11) of JP-A-2-44345.

Couplers the colored dyes of which have an appropriate diffusibility

The couplers disclosed in U.S. Pat. No. 4,366,237, British Patent 2,125,570, EP-B-96873 and German Patent 3,234,533 are preferred as couplers the colored dyes of which have an appropriate diffusibility.

Couplers for correcting the unnecessary absorption of colored dyes

Examples of preferred couplers for correcting the unnecessary absorption of colored dyes include the yellow colored cyan couplers represented by formula (CI), (CII), (CIII) or (CIV) disclosed on page 5 of EP-A-456257 (in particular, YC-86 on page 84); the yellow colored magenta couplers ExM-7 (page 202), EX-1 (page 249), and EX-7 (page 251) disclosed in EP-A-456257; the magenta colored cyan couplers CC-9 (column 8) and CC-13 (column 10) disclosed in U.S. Pat. No. 4,833,069; the coupler (2) (column 8) of U.S. Pat. No. 4,837,136; and the colorless masking couplers represented by formula (A) disclosed in claim 1 of WO 92/11575 (in particular, the compounds disclosed on pages 36 to 45).

Examples of compounds (inclusive of couplers) which release photographically useful residual groups of compounds upon reacting with the oxidation product of a developing agent include the following:

Development inhibitor releasing compounds the compounds represented by formula (I), (II), (III) or (IV) disclosed on page 11 of EP-A-378236 (in particular, T-101 (page 30), T-104 (page 31), T-113 (page 36), T-131 (page 45), T-144 (page 51) and T-158 (page 58)); the compounds represented by formula (I) disclosed on page 7 of EP-A-436938 (in particular, D-49 (page 51)); the compounds represented by formula (1) disclosed in EP-A-568037 (in particular, (23) (page 11)); and the compounds represented by formula (I), (II) or (III) disclosed on pages 5 and 6 of EP-A-440195 (in particular, I-(1) on page 29);

Bleaching accelerator releasing compounds the compounds represented by formula (I) or (I') disclosed on page 5 of EP-A-310125 (in particular, (60) and (61) on page 61); and the compounds represented by formula (I) disclosed in claim 1 of JP-A-6-59411 (in particular, (7) on page 7);

Ligand releasing compounds the compounds represented by LIG-X disclosed in claim 1 of U.S. Pat. No. 4,555,478 (in particular, the compounds in lines 21 to 41, column 12);

Leuco dye releasing compounds compounds 1 to 6, columns 3 to 8 of U.S. Pat. No. 4,749,641;

Fluorescent dye releasing compounds the compounds represented by COUP-DYE disclosed in claim 1 of U.S. Pat. No. 4,774,181 (in particular, compounds 1 to 11, columns 7 to 10);

Development accelerator releasing or fogging agent releasing compounds the compounds represented by formula (1), (2) or (3), column 3 of U.S. Pat. No. 4,656,123 (in particular, (I-22), column 25); and compound ExZK-2, lines 36 to 38, page 75 of EP-A-450637; and Compounds which release dyes the color of which is restored after elimination the compounds represented by formula (I) disclosed in claim 1 of U.S. Pat. No. 4,857,447 (in particular, Y-1 to Y-19, columns 25 to 36).

Preferred additives other than couplers are listed below:

Dispersion mediums of oil-soluble organic compound

P-3, P-5, P-16, P-19, P-25, P-30, P-42, P-49, P-54, P-55, P-66, P-81, P-85, P-86 and P-93 (pages 140 to 144) of JP-A-62-215272;

Latexes for impregnation of oil-soluble organic compound the latexes disclosed in U.S. Pat. No. 4,199,363;

Scavengers for the oxidation product of a developing agent the compounds represented by formula (I), lines 54 to 62, column 2 of U.S. Pat. No. 4,978,606 (in particular, I-(1), I-(2), I-(6) and I-(12), columns 4 and 5); and the compounds represented by the formula disclosed in lines 5 to 10, column 2 of U.S. Pat. No. 4,923,787 (in particular, compound 1, column 3);

Stain inhibitors the compounds represented by formula (I), (II) or (III), lines 30 to 33, page 4 of EP-A-298321 (in particular, I-47, I-72, III-1 and III-27, pages 24 to 48);

Discoloration inhibitors

A-6, A-7, A-20, A-21, A-23, A-24, A-25, A-26, A-30, A-37, A-40, A-42, A-48, A-63, A-90, A-92, A-94 and A-164 (pages 69 to 118) of EP-A-298321; II-1 to III-23, columns 25 to 38 of U.S. Pat. No. 5,122,444 (in particular, III-10); I-1 to III-4, pages 8 to 12 of EP-A-471347 (in particular, II-2); and A-1 to A-48, columns 32 to 40 of U.S. Pat. No. 5,139,931 (in particular, A-39 and A-42);

Compounds for reducing the using amounts of color intensifiers and color mixing preventives I-1 to II-15, pages 5 to 24 of EP-A-411324 (in particular, I-46);

Formaldehyde scavengers

SCV-1 to SCV-28, pages 24 to 29 of EP-A-477932 (in particular, SCV-8);

Hardening agents

H-1, H-4, H-6, H-8 and H-14 on page 17 of JP-A-1214845; the compounds represented by any of formulae (VII) to (XII), columns 13 to 23 of U.S. Pat. No. 4,618,573 (H-1 to H-54); the compounds represented by formula (6), right lower column, page 8 of JP-A-2-214852, (H-1 to H-76) (in particular, H-14); and the compounds disclosed in claim 1 of U.S. Pat. No. 3,325,287;

Development inhibitor precursors

P-24, P-37 and P-39, pages 6 and 7 of JP-A-62-168139; and the compounds disclosed in claim 1 of U.S. Pat. No. 5,019,492 (in particular, compounds 28 and 29, column 7);

Fungicides and biocides

I-1 to III-43, columns 3 to 15 of U.S. Pat. No. 4,923,790 (in particular, II-1, II-9, II-10, II-18 and III-25);

Stabilizers and antifoggants

I-1 to (14), columns 6 to 16 of U.S. Pat. No. 4,923,793 (in particular, I-1, 60, (2) and (13)); and compounds 1 to 65, columns 25 to 32 of U.S. Pat. No. 4,952,483 (in particular, compound 36);

Chemical sensitizers triphenylphosphine selenide; and compound 50 disclosed in JP-A-5-40324;

Dyes a-1 to b-20, pages 15 to 18 (in particular, a-1, a-12, a-18, a-27, a-35, a-36, and b-5), and V-1 to V-23, pages 27 to 29 (in particular, V-1) of JP-A-3-156450; F-I-1 to F-II-43, pages 33 to 55 of EP-A-445627 (in particular, F-I-11 and F-II-8); III-1 to III-36, pages 17 to 28 of EP-A-457153 (in particular, III-1 and III-3); crystallite dispersions of Dye-1 to Dye-124, pages 8 to 26 of WO 88/04794; compounds 1 to 22, pages 6 to 11 of EP-A-319999 (in particular, compound 1); compounds D-1 to D-87 represented by any of formulae (1) to (3), pages 3 to 28 of EP-A-519306; compounds 1 to 22 represented by formula (I), columns 3 to 10 of U.S. Pat. No. 4,268,622; and compounds (1) to (31) represented by formula (I), columns 2 to 9 of U.S. Pat. No. 4,923,788;

Ultraviolet absorbers compounds (18b) to (18r) represented by formula (1), 101 to 427, pages 6 to 9 of JP-A-46-3335; compounds (3) to (66) represented by formula (I), pages 10 to 44, and compounds HBT-1 to HBT-10 represented by formula (III), page 14, of EP-A-520938; and compounds (1) to (31) represented by formula (1), columns 2 to 9 of EP-A-521823.

The present invention can be applied to various color photographic materials such as color negative films for general and cinematographic uses, color reversal films for slide and television uses, color papers, color positive films and color reversal papers as well as B/W photographic materials. The present invention can also preferably be applied to the film units equipped with lenses as disclosed in JP-B-2-32615 and JP-B-U-3-39784 (the term "JP-B-U" as used herein means an "examined Japanese utility model publication").

Suitable supports which can be used in the present invention are disclosed, for example, in RD, No. 17643, page 28, RD, No. 18716, from page 647, right column to page 648, left column, and RD, No. 307105, page 879. Preferred supports are polyester based polymer supports.

The photographic material of the present invention has a total film thickness of all the hydrophilic colloid layers on the side where the emulsion layers are located of preferably 28 $\mu$m or less, more preferably 23 $\mu$m or less, still more preferably 18 $\mu$m or less, and most preferably 16 $\mu$m or less. Further, the film swelling rate $T_{1/2}$ is preferably 30 seconds or less, more preferably 20 seconds or less. $T_{1/2}$ is defined as the time required for the film thickness to reach ½ of the saturated film thickness, taking 90% of the maximum swollen film thickness reached when being processed at 30° C. for 3 minutes and 15 seconds in a color developing solution as the saturated film thickness. The film thickness means the film thickness measured under conditions of 25° C., 55% relative humidity (stored for two days), and $T_{1/2}$ can be measured using a swellometer of the type described in A. Green et al., *Photogr. Sci. Eng.*, Vol. 19, No. 2, pages 124 to 129. $T_{1/2}$ can be adjusted by adding hardening agents to gelatin which is used as a binder, or by changing the aging conditions after coating. Further, a swelling factor of from 150% to 400% is preferred. The swelling factor can be calculated from the maximum swollen film thickness obtained under the conditions described above using the equation: (maximum swollen film thickness—film thickness)/film thickness.

Backing layers of the photographic material of the present invention on the side of the support opposite to the side on which emulsion layers are provided preferably have a total dry film thickness of from 2 $\mu$m to 20 $\mu$m. The inclusion of the above-described light absorbers, filter dyes, ultraviolet absorbers, antistatic agents, hardening agents, binders, plasticizers, lubricants, coating aids, and surfactants in backing layers is preferred. The swelling factor of backing layers is preferably from 150 to 500%.

The photographic material of the present invention can be development processed by ordinary methods disclosed in RD, No. 17643, pages 28 and 29, RD, No. 18716, page 651, from left column to right column, and RD, No. 307105, pages 880 and 881.

Processing solutions for a color negative film for use in one embodiment of the present invention are described below.

A color developing solution for use in the present invention can contain the compounds disclosed in line 1, right upper column, page 9 to line 4, left lower column, page 11 of JP-A-4-121739. In particular, when rapid processing is carried out, 2-methyl-4-[N-ethyl-N-(2-hydroxyethyl)amino] aniline, 2-methyl-4-[N-ethyl-N-(3-hydroxypropyl)amino] aniline, and 2-methyl-4-[N-ethyl-N-(4-hydroxybutyl) amino]aniline are preferably used as color developing agents.

These color developing agents are contained in a color developing solution preferably in an amount of from 0.01 to 0.08 mol, more preferably from 0.015 to 0.06 mol, and still more preferably from 0.02 to 0.05 mol, per liter of the color developing solution. These color developing agents are preferably contained in the replenisher of a color developing solution from 1.1 to 3 times, in particular, from 1.3 to 2.5 times, of the above concentration.

As hydroxylamine can be widely used as a preservative of a color developing solution, when higher preservability is required, hydroxylamine derivatives having an alkyl group, a hydroxyalkyl group, a sulfoalkyl group or a carboxyalkyl group as a substituent are preferred. Specifically, N,N-di (sulfoethyl)hydroxylamine, monomethylhydroxylamine, dimethylhydroxylamine, monoethylhydroxylamine, diethylhydroxylamine, and N,N-di(carboxyethyl) hydroxylamine are preferably used. N,N-Di(sulfoethyl) hydroxylamine is particularly preferred of the above. These compounds can be used in combination with hydroxylamine, but they are preferably used in combination of one or two or more in place of hydroxylamine.

A preservative is preferably used in an amount of from 0.02 to 0.2 mol, more preferably from 0.03 to 0.15 mol, and still more preferably from 0.04 to 0.1 mol, per liter of the color developing solution. In the replenisher, same as the color developing agent, a preservative is preferably contained in the concentration of from 1.1 to 3 times of the mother solution (processing tank solution).

In a color developing solution, sulfite is used to prevent the oxidized product of a color developing agent from becoming tar. The concentration of sulfite in a color developing solution is preferably from 0.01 to 0.05 mol, particularly preferably from 0.02 to 0.04 mol, per liter of the color developing solution. In the replenisher, it is preferred to use sulfite in the concentration of from 1.1 to 3 times of these amounts.

The pH of a color developing solution is preferably from 9.8 to 11.0, and particularly preferably from 10.0 to 10.5, and the pH of the replenisher is preferably set at the value by 0.1 to 1.0 higher than the above value. Known pH buffers such as carbonate, phosphate, sulfosalicylate, and borate are used for stably maintaining the pH.

The replenishing rate of a color developing solution is preferably from 80 to 1,300 ml per $m^2$ of the photographic material but, the less is the better, from the viewpoint of the reduction of environmental pollution, and is generally from 80 to 600 ml, preferably from 80 to 400 ml.

The concentration of bromide ion in a color developing solution is generally from 0.01 to 0.06 mol per liter but for purposes of preventing the generation of fog and improving the discrimination while maintaining the sensitivity and, further, improving graininess, it is preferred to set the concentration from 0.015 to 0.03 mol per liter. When the concentration of bromide ion is defined in such a range, the concentration of bromide ion in the replenisher can be obtained from the following equation, however, when C is minus, bromide ion is preferably not contained in the replenisher.

$$C=A-W/V$$

C: The concentration of bromide ion in the replenisher of the color developing solution (mol/liter)

A: The concentration of bromide ion in the objective color developing solution (mol/liter)

W: The amount of bromide ion dissolved out from the photographic material into the color developing solution when $m^2$ of the photographic material is color developed (mol)

V: The replenishing rate of the color developing replenisher per $m^2$ of the photographic material (liter)

Moreover, when the replenishing rate is reduced or bromide ion is set in a high concentration, as a method of increasing the sensitivity, pyrazolidones such as 1-phenyl-3-pyrazolidone and 1-phenyl-2-methyl-2-hydroxymethyl-3-pyrazolidone, and thioether compounds such as 3,6-dithia-1,8-octanediol are preferably used as a development accelerator.

The compounds and the processing conditions disclosed in line 16, left lower column, page 4 to line 6, left lower column, page 7 of JP-A-4-125558 can be applied to the processing solution having bleaching ability of the present invention.

A bleaching agent having an oxidation reduction potential of 150 mV or more is preferred, and specific examples thereof disclosed in JP-A-5-72694 and JP-A-5-173312 are preferably used in the present invention, in particular, 1,3-diaminopropanetetraacetic acid and the ferric complex salt of the compounds in specific example 1, page 7 of JP-A-5-173312 are preferred.

In addition, for improving the biodegradability of a bleaching agent, it is preferred to use the ferric complex salt of the compounds disclosed in JP-A-4-251845, JP-A-4-268552, EP-A-588289, EP-A-591934, and JP-A-6-208213 as a bleaching agent. The concentration of these bleaching agents is preferably from 0.05 to 0.3 mol per liter of the processing solution having bleaching ability, and for reducing the discharge amount to the environment, the concentration of from 0.1 to 0.15 mol per liter is preferred. When the solution having bleaching ability is a bleaching solution, it is preferred to contain bromide in an amount of from 0.2 to 1 mol, and particularly preferably from 0.3 to 0.8 mol, per liter of the bleaching solution.

The replenisher of the solution having bleaching ability contains fundamentally the concentration of each component calculated by the following equation. According to this procedure, the concentration in the mother solution can be maintained constant.

$$C_R=C_T\times(V_1+V_2)/V_1+C_P$$

$C_R$: The concentration of the component in the replenisher $C_T$: The concentration of the component in the mother solution (processing tank solution)

$C_P$: The concentration of the component consumed during processing $V_1$: The replenishing rate of the replenisher having bleaching ability per $m^2$ of the photographic material (ml)

$V_2$: The amount of the carryover from the prebath by $m^2$ of the photographic material (ml)

In addition, a bleaching solution preferably contains a pH buffer, in particular, comparatively odorless dicarboxylic acids such as succinic acid, maleic acid, malonic acid, glutaric acid, and adipic acid are preferred. It is also preferred to use known bleaching accelerators disclosed in JP-A-53-95630, RD, No. 17129, and U.S. Pat. No. 3,893,858.

A bleaching solution is preferably replenished with a bleaching replenisher in an amount of from 50 to 1,000 ml per $m^2$ of the photographic material, more preferably from 80 to 500 ml and most preferably from 100 to 300 ml. Further, a bleaching solution is preferably conducted aeration.

The compounds and the processing conditions disclosed in line 10, left lower column, page 7 to line 19, right lower column, page 8 of JP-A-4-125558 can be applied to the processing solution having fixing ability.

In particular, for improving fixing speed and preservability, the compounds represented by formula (I) or (II) disclosed in JP-A-6-301169 are preferably added to the processing solution having fixing ability alone or in combination. Further, the use of the sulfinic acid disclosed in JP-A-1-224762 as well as p-toluenesulfinate is preferred for improving preservability.

In the solution having bleaching ability and the solution having fixing ability, ammonium is preferably used as a cation for improving desilvering ability but taking the reduction of the environmental pollution into consideration, ammonium is preferably reduced or, if possible, not contained at all.

In bleaching, blixing and fixing processes, it is particularly preferred to carry out the jet stirring as disclosed in JP-A-1-309059.

The replenishing rate of the replenisher in blixing process or fixing process is from 100 to 1,000 ml, preferably from 150 to 700 ml, and particularly preferably from 200 to 600 ml, per $m^2$ of the photographic material.

It is preferred to recover silver by installing various silver recovery devices by in-line and off-line systems in blixing and fixing processes. Using an in-line system, processing can be carried out with a reduced concentration of silver in a solution, as a result, the replenishing rate can be reduced. Further, it is also preferred to recover silver by an off-line system and reuse the solution as a replenisher after silver recovery.

Blixing process and fixing process may comprise a plurality of processing tanks and it is preferred to adopt a multistage countercurrent system with each tank being arranged in cascade piping. From the balance with the size of a processor, in general, two-tank cascade structure is effective and the proportion of the processing time in the preceding tank and the succeeding tank is preferably from 0.5/1 to 1/0.5, particularly preferably from 0.8/1 to 1/0.8.

From the viewpoint of improving preservability, it is preferred that a free chelating agent not in the form of a metal complex is contained in a blixing solution or a fixing solution, and the biodegradable chelating agent described above with respect to the bleaching solution is preferably used as such a chelating agent.

With respect to washing and stabilizing processes, the contents disclosed in line 6, right lower column, page 12 to line 16, right lower column, page 13 of the above JP-A-4-125558 can be preferably applied to the present invention. In particular, the use of the azolylmethylamines disclosed in EP-A-504609 and EP-A-519190, or the N-methylolazoles disclosed in JP-A-4-362943 in place of formaldehyde in a stabilizing solution, and the elimination of image stabilizers such as formaldehyde from a stabilizing solution, by introducing a 2-equivalent magenta coupler into a photographic material are preferred from the work environmental protection.

Further, the stabilizing solution disclosed in JP-A-6-289559 can preferably be used to reduce the adhesion of dusts to a magnetic recording layer coated on a photographic material.

The replenishing rate of washing water and a stabilizing solution is preferably from 80 to 1,000 ml, more preferably from 100 to 500 ml, and still more preferably from 150 to 300 ml, per $m^2$ of the photographic material, which is a preferred range from both sides of the security of washing or stabilizing function and the reduction of waste solution for environmental protection. In processing with such a replenishing rate, it is preferred to use known fungicides such as thiabendazole, 1,2-benzisothiazolin-3-one, and 5-chloro-2-methylisothiazolin-3-one, antibiotics such as gentamycin, and deionized water by ion exchange resins to prevent proliferation of bacteria and fungus. It is more effective to use deionized water with biocides and antibiotics in combination.

The solution in a washing or stabilizing tank is preferably treated by reverse osmosis treatment as disclosed in JP-A-3-46652, JP-A-3-53246, JP-A-3-55542, JP-A-3-121448 and JP-A-3-126030 to reduce the replenishing rate, and in this case a reverse osmosis membrane is preferably a low pressure reverse osmosis membrane.

In the processing of the present invention, it is particularly preferred to conduct the compensation of evaporation of processing solutions as disclosed in Hatsumei-Kyokai, Kokai-Giho, Kogi No. 94-4992. In particular, according to formula-1 on page 2 of the above literature, the method of compensation based on the information of the temperature and humidity of the atmosphere where the processor is installed is preferred. The water to be used for the compensation of evaporation is preferably drawn from the replenisher tank of water washing, and in such a case deionized water is preferably used as the water washing replenisher.

The processing chemicals disclosed in line 15, right column, page 3 to line 32, left column, page 4 of the above Kokai Giho are preferred as processing chemicals for the color photographic material used in the present invention. The film processor disclosed in lines 22 to 28, right column, page 3 of the above Kokai Giho is preferably used therefor.

Preferred processing chemicals, automatic processors, and specific examples of the evaporation compensation method for carrying out the present invention are disclosed in line 11, right column, page 5 to the last line, right column, page 7 of the above Kokai Giho.

The processing chemicals for use in the present invention may be supplied in any form such as the solution of the concentration of the working solutions, concentrated solutions, granulated powders, dusting powders, tablets, paste or emulsions. As examples of such processing chemicals, there are solution chemicals contained in a low oxygen permeable container disclosed in JP-A-63-17453, vacuum packaged dusting powders and granulated powders disclosed in JP-A-4-19655 and JP-A-4-230748, granulated powders containing water-soluble polymers disclosed in JP-A-4-221951, tablets disclosed in JP-A-51-61837 and JP-A-6-102628, and paste-like processing chemicals disclosed in JP-A-57-500485, and any of these can be used preferably, but from the convenience at the time of use, it is preferred to use solution chemicals previously prepared in the concentration of the working solutions.

As the materials of containers for these processing chemicals, polyethylene, polypropylene, polyvinyl chloride, polyethylene terephthalate, and nylon are used alone or as a composite material. Materials are selected according to the levels of the oxygen permeability required. Materials of low oxygen permeability are preferred for a solution which is liable to be oxidized, for example, a color developing solution, specifically, polyethylene terephthalate and a composite material of polyethylene and nylon are preferred. These materials preferably have a thickness of from 500 to 1,500 μm and oxygen permeability of 20 ml/m$^2$·24 hrs·atm or less.

Processing solutions for the color reversal film for use in one embodiment of the present invention are described below.

The processing for a color reversal film is disclosed in detail in line 5, page 1 to line 5, page 10 and line 8, page 15 to line 2, page 24 of *Kochi Gilutsu* (*Known Techniques*), No. 6 (Apr. 1st, 1991) published by Aztec Co., Ltd. and the contents are all preferably applicable to the present invention.

In the processing of a color reversal film, an image stabilizer is contained in an adjusting bath or a final bath. Examples of image stabilizers include, in addition to formalin, sodium formaldehyde bisulfite and N-methylolazoles, but considering the work environment, sodium formaldehyde bisulfite or N-methylolazoles are preferred and N-methyloltriazole is particularly preferred of N-methylolazoles. In addition, the above descriptions with respect to color developing solutions, bleaching solutions, fixing solutions and washing water described in the processing of a color negative film can also be preferably applied to the processing of a color reversal film.

As preferred processing chemicals for a color reversal film containing the above contents, E-6 processing chemical manufactured by Eastman Kodak and CR-56 processing chemical manufactured by Fuji Photo Film Co., Ltd. can be cited.

The polyester support for use in the present invention is described below, but details including photographic materials other than described above, processing, cartridges and working examples are disclosed in Kokai-Giho, Kogi No. 94-6023 (Hatsumei-Kyokai, Mar. 15, 1994). The polyester for use in the present invention comprises diol and aromatic dicarboxylic acid as essential components, and as aromatic dicarboxylic acids, 2,6-, 1,5-, 1,4- and 2,7-naphthalenedicarboxylic acid, terephthalic acid, isophthalic acid, and phthalic acid, and as diols, diethylene glycol, triethylene glycol, cyclohexanedimethanol, bisphenol A, and bisphenol can be enumerated. Polymerized polymers thereof include homopolymers such as polyethylene terephthalate, polyethylene naphthalate, polycyclohexanedimethanol terephthalate and the like. Particularly preferred is polyester comprising from 50 mol % to 100 mol % of 2,6-naphthalenedicarboxylic acid. Particularly preferred above all is polyethylene 2,6-naphthalate. The average molecular weight of them is about 5,000 to 200,000. Tg of the polyester for use in the present invention is 50° C. or more, and 90° C. or more is preferred.

The polyester support is heat treated at 40° C. or more and less than Tg, more preferably Tg minus 20° C. or more to less than Tg for the purpose of being reluctant to get curling habit. The heat treatment may be carried out at constant temperature within this range or may be carried out with cooling. The heat treatment time is from 0.1 hours to 1,500 hours, preferably from 0.5 hours to 200 hours. The heat treatment of the support may be carried out in a roll state or may be carried out in a web state while transporting. The surface of the support may be provided with concave and convex (e.g., by coating conductive inorganic fine particles such as $SnO_2$ or $Sb_2O_5$) to improve the surface state. Also, it is preferred to make some designs such that the edge is knurled to slightly increase the height only of the edge, thereby preventing the difference in level due to the edge from imparting the evenness of support wound thereon. The heat treatment may be carried out at any stage of after the formation of the support, after the surface treatment, after coating of a backing layer (an antistatic agent, a sliding agent, etc.), or after undercoating, but preferably conducted after coating of an antistatic agent.

An ultraviolet absorber may be incorporated into the polyester support. Further, light piping can be prevented by including the commercially available dye or pigment for polyester such as Diaresin manufactured by Mitsubishi Kasei Corp. or Kayaset manufactured by Nippon Kayaku Co., Ltd.

To ensure adhesion of the support and the constitu- tional layers of the photographic material, the surface activation treatment is preferably carried out, such as a chemical treatment, a mechanical treatment, a corona discharge treatment, a flame treatment, an ultraviolet treatment, a high frequency treatment, a glow discharge treatment, an active plasma treatment, a laser treatment, a mixed acid treatment, and an ozone oxidation treatment, and preferred of them are an ultraviolet irradiation treatment, a flame treatment, a corona discharge treatment, and a glow discharge treatment.

An undercoating method is described below. An undercoat layer may be a single layer or may comprise two or more layers. The binder for an undercoat layer include copolymers with monomers selected from vinyl chloride, vinylidene chloride, butadiene, methacrylic acid, acrylic acid, itaconic acid and maleic anhydride being starting materials, as well as polyethyleneimine, an epoxy resin, grafted gelatin, nitrocellulose and gelatin. Compounds which swell the support include resorcin and p-chlorophenol. A gelatin hardening agent for an undercoat layer include chromium salt (chrome alum), aldehydes (formaldehyde, glutaraldehyde), isocyanates, active halide compounds (2,4-dichloro-6-hydroxy-S-triazine), epichlorohydrin resins, and active vinyl sulfone compounds. $SiO_2$, $TiO_2$, inorganic fine particles or polymethyl methacrylate copolymer fine particles (0.01 to 10 μm) may be contained as a matting agent.

Further, antistatic agents are preferably used in the present invention. Examples of such antistatic agents include high polymers containing a carboxylic acid, a carboxylate, or a sulfonate, cationic high polymers, and ionic surfactant compounds.

The most preferred antistatic agents are fine particles of a crystalline metal oxide of at least one particle selected from ZnO, $TiO_2$, $SnO_2$, $Al_2O_3$, $In_2O_3$, $SiO_2$, MgO, BaO, $MoO_3$ and $V_2O_5$ having a volume resistivity of $10^7$ Ω.cm or less, more preferably $10^5$ Ω.cm or less, and having a particle size of from 0.001 to 1.0 μm, or fine particles of composite oxides of them (Sb, P, B, In, S, Si, C), further, fine particles of a metal oxide in the form of sol or fine particles of these composite oxides. The addition amount to the photographic material is preferably from 5 to 500 mg/m$^2$ and particularly preferably from 10 to 350 mg/m$^2$. The ratio of the conductive crystalline oxides or composite oxides thereof to the binder is preferably from 1/300 to 100/1 and more preferably from 1/100 to 100/5.

The photographic material of the present invention preferably contains a matting agent. The matting agent may be added to either of the emulsion layer side or the backing layer side but it is particularly preferably to be added to the outermost layer on the emulsion layer side. The matting agent may be either soluble or insoluble in a processing solution, preferably both types are used in combination. For example, polymethyl methacrylate, poly(methyl methacrylate/methacrylic acid=9/1 or 5/5 (mol ratio)), and polystyrene particles are preferably used. The average particle size is preferably from 0.8 to 10 μm, and particle size distribution is preferably narrower, preferably 90% or more of the entire particle number accounts for 0.9 to 1.1 times of the average particle size. For increasing the matting property, fine particles having a particle size of 0.8 μm or less are preferably added at the same time. For example, polymethyl methacrylate (0.2 μm), poly(methyl methacrylate/methacrylic acid=9/1 (mol ratio), 0.3 μm), polystyrene particles (0.25 μm), and colloidal silica (0.03 μm) are enumerated.

The film patrone preferably used in the present invention is described below. The main material of the patrone for use in the present invention may be metal or synthetic plastics.

Preferred plastic materials are polystyrene, polyethylene, polypropylene, polyphenyl ether, etc. Further, the patrone for use in the present invention may contain various antistatic agents, and carbon black, metal oxide particles, nonionic, anionic, cationic and betaine based surfactants or polymers can be preferably used. Such a patrone static prevented is disclosed in JP-A-1-312537 and JP-A-1-312538. In particular, those having the resistance of $10^{12}\Omega$ or less at 25° C., 25% RH are preferred. Usually, plastic patrone is produced using plastics including carbon black or a pigment to impart light shielding. The size of the patrone may be 135 size of the present as it is, or for miniaturizing a camera, it is effective that the diameter of the cartridge of 25 mm of the present 135 size may be decreased to 22 mm or less. The capacity of the case of the patrone is 30 $cm^3$ or less and preferably 25 $cm^3$ or less. The weight of the plastics used for the patrone and patrone case is preferably from 5 g to 15 g.

Further, the patrone for use in the present invention may be a type of sending out the film by revolving a spool. Further, it may be the structure such that the tip of the film is encased in the body of the patrone and the tip of the film is sent to outside through the port of the patrone by revolving the axle of the spool in the feeding direction of the film. These structures are disclosed in U.S. Pat. Nos. 4,834,306 and 5,226,613. The photographic film for use in the present invention may be a so-called raw film before development or may be a photographic film development processed. Further, a raw film and a processed film may be encased in the same new patrone, or may be stored in different patrones.

When the present invention is applied to black-and-white photographic materials, various additives and development processing methods used therefor are not particularly limited, and those disclosed in the following places of JP-A-2-68539, JP-A-5-11389 and JP-A-2-58041 can be preferably used.

| | |
|---|---|
| 1. Silver halide emulsion and the preparation method thereof | from 6 lines up from the bottom, right lower column, page 8 to line 12, right upper column, page 10 of JP-A-2-68539 |
| 2. Chemical sensitization method | from line 13, right upper column, page 10 to line 16, left lower column, page 10 of JP-A-2-68539; selenium sensitization method disclosed in JP-A-5-11389 |
| 3. Antifoggant and stabilizer | from line 17, left lower column, page 10 to line 7, left upper column, page 11 of JP-A-2-68539; from line 2, left lower column, page 3 to left lower column, page 4 of JP-A-2-68539 |
| 4. Spectral sensitizing dye | from line 4, right lower column, page 4 to right lower column, page 8 of JP-A-2-68539; from line 8, left lower column, page 12 to line 19, right lower column, page 12 of JP-A-2-58041 |
| 5. Surfactant and antistatic agent | from line 14, left upper column, page 11 to line 9, left upper column, page 12 of JP-A-2-68539; from line 14, left lower column, page 2 to line 12, left lower column, page 5 of JP-A-2-58041 |
| 6. Matting agent, plasticizer and sliding agent | from line 10, left upper column, page 12 to line 10, right upper column, page 12 of JP-A-2-68539; from line 13, left lower column, page 5 to line 3, left lower co1umn, page 10 of JP-A-2-58041 |
| 7. Hydrophilic colloid | from line 11, right upper column, page 12 to line 16, left lower column page 12 of JP-A-2-68539 |
| 8. Hardening agent | from line 17, left lower column, page 12 to line 6, right upper column, page 13 of JP-A-2-68539 |
| 9. Deyelopment processing method | from line 14, left upper column, page 15 to line 13, left lower column, page 15 of JP-A-2-68539 |

The present invention will be illustrated in more detail with reference to examples below, but these are not to be construed as limiting the invention.

EXAMPLE 1

1) Support

The support which was used in the present invention was prepared as follows.

One hundred (100) weight parts of polyethylene-2,6-naphthalate polymer and 2 weight parts of Tinuvin P. 326 (product of Ciba Geigy), as an ultraviolet absorber, were dried, then melted at 300° C., subsequently, extruded through a T-type die, and stretched 3.3 times in a machine direction at 140° C. and then 3.3 times in a transverse direction at 130° C., and further thermal fixed for 6 seconds at 250° C. and the PEN film having the thickness of 90 μm was obtained. Appropriate amounts of blue dyes, magenta dyes and yellow dyes were added to this PEN film (I-1, I-4, I-6, I-24, I-26, I-27 and II-5 disclosed in Kokai-Giho, Kogi No. 94-6023). Further, the film was wound on to a stainless steel spool having a diameter of 20 cm and provided heat history at 110° C. for 48 hours to obtain a support reluctant to get curling habit.

2) Coating of Undercoat Layer

After both surfaces of the above support were subjected to corona discharge, UV discharge and glow discharge treatments, on one side of the support an undercoat solution having the following composition was coated (10 ml/$m^2$, using a bar coater): 0.1 g/$m^2$ of gelatin, 0.01 g/$m^2$ of sodium α-sulfo-di-2-ethylhexylsuccinate, 0.04 g/$m^2$ of salicylic acid, 0.2 g/$m^2$ of p-chlorophenol, 0.012 g/$m^2$ of $(CH_2{=}CHSO_2CH_2CH_2NHCO)_2CH_2$, and 0.02 g/$m^2$ of polyamideepichlorohydrin polycondensation product. The undercoat layer was provided on the hotter side at the time of stretching. Drying was conducted at 115° C. for 6 minutes (the temperature of the roller and the transporting device of the drying zone was 115° C.).

3) Coating of Backing Layer

On one side of the above support after undercoat layer coating, which side was opposite to the side on which the undercoat solution was coated, an antistatic layer, a magnetic recording layer and a sliding layer having the following compositions were coated as backing layers.

3-1) Coating of Antistatic Layer

Zero point two (0.2) gram/$m^2$ of a dispersion of fine particle powder of a stannic oxide-antimony oxide composite having the average particle size of 0.005 $\mu$m and specific resistance of 5 Ω.cm (the particle size of the second agglomerate: about 0.08 $\mu$m), 0.05 g/$m^2$ of gelatin, 0.02 g/$m^2$ of $(CH_2{=}CHSO_2CH_2CH_2NHCO)_2CH_2$, 0.005 g/$m^2$ of polyoxyethylene-p-nonylphenol (polymerization degree: 10) and 0.01 g/$m^2$ of resorcin were coated.

3-2) Coating of Magnetic Recording Layer

Zero point zero six (0.06) gram/$m^2$ of cobalt-γ-iron oxide which was coating-treated with 3-polyoxyethylenepropyloxytrimethoxysilane (polymerization degree: 15) (15 wt %) (specific surface area: 43 $m^2$/g, major axis: 0.14 $\mu$m, minor axis: 0.03 $\mu$m, saturation magnetization: 89 emu/g, $Fe^{+2}/Fe^{+3}$ is 6/94, the surface was treated with 2 wt %, respectively, based on the iron oxide, of aluminum oxide and silicon oxide), 1.2 g/$m^2$ of diacetyl cellulose (DAC) (dispersion of the iron oxide was carried out using an open kneader and a sand mill) and 0.3 g/$m^2$ of $C_2H_5C[CH_2OCONH{-}C_6H_3(CH_3)NCO]_3$ as a curing agent, with acetone, methyl ethyl ketone and cyclohexanone as solvents, were coated with a bar coater to obtain a magnetic recording layer having the film thickness of 1.2 $\mu$m. Ten (10) mg/$m^2$ of silica particles (0.3 $\mu$m) as a matting agent and 10 mg/$m^2$ of an aluminum oxide abrasive (0.15 $\mu$m) coating-treated with 3-polyoxyethylenepropyloxytrimethoxysilane (polymerization degree: 15) (15 wt %) were added. Drying was conducted at 115° C. for 6 minutes (the temperature of the roller and the transporting device of the drying zone was 115° C.). The increase of the color density of $D^B$ of the magnetic recording layer by X-light (a blue filter) was about 0.1, and saturation magnetization moment of the magnetic recording layer was 4.2 emu/g, coercive force was $7.3\times10^4$ A/m, and rectangular ratio was 65%.

3-3) Preparation of Sliding Layer

Support Nos. 101 to 141 having different backing layers were prepared by coating-on the above support each of mixtures of a binder and $(n)C_{50}H_{101}O(CH_2CH_2O)_{16}H$ (Compound (A)) and a higher fatty acid or a derivative thereof as a sliding agent varying the kind and the coating amount, or changing the sliding agent to other sliding agent, as shown in Tables 1 and 2. Each of these mixtures was melted in xylene/propylene glycol monomethyl ether (1/1 by volume) by heating at 105° C., and the solution was poured into propylene glycol monomethyl ether (10 time amount) at room temperature and dispersed, and the dispersion was further dispersed in acetone (average particle size: 0.01 $\mu$m) and then added to the coating solution. Fifteen (15) mg/$m^2$ of silica particles (0.3 $\mu$m) as a matting agent and 15 mg/$m^2$ of an aluminum oxide abrasive (0.15 $\mu$m) coating-treated with 3-polyoxyethylenepropyloxytrimethoxysilane (polymerization degree: 15) (15 wt %) were added. Coating amounts of the matting agent and the abrasive of each support were the same amounts. DAC Tables 1 and 2 is the above diacetyl cellulose. B-3 is compound shown below. Drying was conducted at 115° C. for 6 minutes (the temperature of the roller and the transporting device of the drying zone was 115° C.). The measured value of the dynamic friction coefficient (a stainless steel hard ball of 5 mmϕ, load: 100 g, speed: 6 cm/min) of each sliding layer was also shown in Tables 1 and 2.

TABLE 1

| | Sliding Agent | | Binder | | Weight Ratio of | | | Adhesion |
|---|---|---|---|---|---|---|---|---|
| Support No. | Compound | Coating Amount (mg/$m^2$) | Compound | Coating Amount (mg/$m^2$) | Sliding Agent/ Binder | Dynamic Friction Coefficient | Magnetic Read Error | of Dusts and Chips |
| 101 (Comparison) | Cpd. (A)* | 7.5 | HAC-6 | 30 | 0.5 | 0.13 | 651 | 5 |
| | (10) | 7.5 | | | | | | |
| 102 (Invention) | Cpd. (A)* | 7.5 | " | 15 | 1.0 | 0.12 | 92 | 4 |
| | (10) | 7.5 | | | | | | |
| 103 (Invention) | Cpd. (A)* | 7.5 | " | 5.0 | 3.0 | 0.10 | 15 | 3 |
| | (10) | 7.5 | | | | | | |
| 104 (Invention) | Cpd. (A)* | 7.5 | " | 3.0 | 5.0 | 0.09 | 3 | 2 |
| | (10) | 7.5 | | | | | | |
| 105 (Invention) | Cpd. (A)* | 7.5 | " | 1.5 | 10 | 0.09 | 0 | 1 |
| | (10) | 7.5 | | | | | | |
| 106 (Invention) | Cpd. (A)* | 7.5 | " | 0.5 | 30 | 0.08 | 0 | 1 |
| | (10) | 7.5 | | | | | | |
| 107 (Invention) | Cpd. (A)* | 7.5 | " | 0.15 | 100 | 0.07 | 0 | 1 |
| | (10) | 7.5 | | | | | | |
| 108 (Invention) | Cpd. (A)* | 7.5 | " | 0.05 | 300 | 0.07 | 0 | 1 |
| | (10) | 7.5 | | | | | | |
| 109 (Invention) | Cpd. (A)* | 7.5 | " | $1.5\times10^{-3}$ | $1\times10^3$ | 0.07 | 0 | 1 |
| | (10) | 7.5 | | | | | | |
| 110 (Invention) | Cpd. (A)* | 7.5 | " | $5\times10^{-3}$ | $3\times10^3$ | 0.07 | 0 | 1 |
| | (10) | 7.5 | | | | | | |
| 111 (Invention) | Cpd. (A)* | 7.5 | " | $1.5\times10^{-3}$ | $1\times10^4$ | 0.07 | 0 | 1 |
| | (10) | 7.5 | | | | | | |
| 112 (Comparison) | Cpd. (A)* | 7.5 | " | $0.5\times10^{-3}$ | $3\times10^4$ | 0.07 | 2 | 1 |
| | (10) | 7.5 | | | | | | |
| 113 (Invention) | Cpd. (A) | 7.5 | HAC-1 | 1.5 | 10 | 0.09 | 0 | 1 |
| | (10) | 7.5 | | | | | | |
| 114 (Invention) | Cpd. (A) | 7.5 | HAC-3 | 0.5 | 30 | 0.08 | 0 | 1 |
| | (10) | 7.5 | | | | | | |
| 115 (Invention) | Cpd. (A) | 7.5 | HAC3 | 0.05 | 300 | 0.07 | 0 | 1 |
| | (10) | 7.5 | | | | | | |

TABLE 1-continued

| Support No. | Sliding Agent Compound | Sliding Agent Coating Amount ($mg/m^2$) | Binder Compound | Binder Coating Amount ($mg/m^2$) | Weight Ratio of Sliding Agent/Binder | Dynamic Friction Coefficient | Magnetic Read Error | Adhesion of Dusts and Chips |
|---|---|---|---|---|---|---|---|---|
| 116 (Invention) | Cpd. (A)<br>(10) | 7.5<br>7.5 | HAC-4 | 1.0 | 15 | 0.09 | 0 | 1 |
| 117 (Invention) | Cpd. (A)<br>(10) | 7.5<br>7.5 | HAC-5 | 0.8 | 18.75 | 0.08 | 0 | 1 |
| 118 (Invention) | Cpd. (A)<br>(10) | 7.5<br>7.5 | HAC-11 | 1.25 | 12 | 0.09 | 0 | 1 |
| 119 (Invention) | Cpd. (A)<br>(10) | 7.5<br>7.5 | HAC-13 | 0.65 | 23.1 | 0.08 | 0 | 1 |
| 120 (Invention) | Cpd. (A)<br>(10) | 7.5<br>7.5 | DAC** | 0.5 | 30 | 0.10 | 127 | 2 |
| 121 (Invention) | Cpd. (A)<br>(5) | 7.5<br>7.5 | HAC-6 | 0.05 | 300 | 0.08 | 0 | 1 |
| 122 (Invention) | Cpd. (A)<br>(12) | 7.5<br>7.5 | " | " | " | 0.08 | 0 | 1 |
| 123 (Invention) | Cpd. (A)<br>(17) | 7.5<br>7.5 | " | " | " | 0.08 | 0 | 1 |
| 124 (Invention) | Cpd. (A)<br>(20) | 7.5<br>7.5 | " | " | " | 0.08 | 0 | 1 |
| 125 (Invention) | Cpd. (A) | 7.5<br>7.5 | " | " | " | 0.11 | 24 | 2 |
| 126 (Invention) | B-3<br>(10) | 7.5<br>7.5 | " | " | " | 0.10 | 12 | 2 |

TABLE 2

| Support No. | Sliding Agent Compound | Sliding Agent Coating Amount ($mg/m^2$) | Binder Compound | Binder Coating Amount ($mg/m^2$) | Weight Ratio of Sliding Agent/Binder | Dynamic Friction Coefficient | Magnetic Read Error | Adhesion of Dusts and Chips |
|---|---|---|---|---|---|---|---|---|
| 127 (Invention) | (10) | 20.0 | HAC-6 | 0.02 | 1,000 | 0.07 | 0 | 1 |
| 128 (Invention) | (4) | 20.0 | " | " | " | 0.07 | 0 | 1 |
| 129 (Invention) | (14) | 20.0 | " | " | " | 0.07 | 0 | 1 |
| 130 (Invention) | (23) | 20.0 | " | " | " | 0.07 | 0 | 1 |
| 131 (Invention) | Cpd. (A) | 20.0 | " | " | " | 0.08 | 6 | 1 |
| 132 (Invention) | B-3 | 20.0 | " | " | " | 0.11 | 18 | 2 |
| 133 (Invention) | Cpd. (A)<br>(10) | 0.5<br>0.5 | HAC-6 | 0.01 | 100 | 0.10 | 21 | 3 |
| 134 (Invention) | Cpd. (A)<br>(10) | 2.5<br>2.5 | HAC-6 | 0.05 | 100 | 0.08 | 5 | 2 |
| 135 (Invention) | Cpd. (A)<br>(10) | 15.0<br>15.0 | HAC-6 | 0.30 | 100 | 0.07 | 0 | 1 |
| 136 (Invention) | Cpd. (A)<br>(10) | 35.0<br>35.0 | HAC-6 | 0.70 | 100 | 0.07 | 0 | 1 |
| 137 (Invention) | Cpd. (A)<br>(10) | 1.0<br>1.0 | HAC-6 | 1.0 | 2 | 0.11 | 32 | 3 |
| 138 (Invention) | Cpd. (A)<br>(10) | 2.5<br>2.5 | HAC-6 | 1.0 | 5 | 0.09 | 7 | 2 |
| 139 (Invention) | Cpd. (A)<br>(10) | 5.0<br>5.0 | HAC-6 | 1.0 | 10 | 0.07 | 3 | 1 |
| 140 (Invention) | Cpd. (A)<br>(10) | 12.5<br>12.5 | HAC-6 | 1.0 | 25 | 0.07 | 0 | 1 |
| 141 (Invention) | Cpd. (A)<br>(10) | 25.0 | HAC-6 | 1.0 | 50 | 0.07 | 0 | 1 |

*Compound (A): $(n)C_{50}H_{101}O(CH_2CH_2O)_{16}H$
**DAC: Diacetyl cellulose
***B-3:

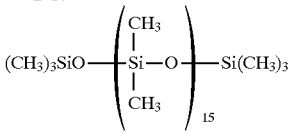

4) Coating of Light-Sensitive Layer

Next, each layer having the following composition was simultaneously multilayer coated at one time on the opposite side of the above obtained backing layer of each of Support Nos. 101 to 141 and a color negative films were prepared as samples of Support Nos. 101 to 141 (Sample Nos. 101 to 141).

Composition of Light-Sensitive Layer

The main components for use in each layer are classified as follows:

ExC: Cyan Coupler

ExM: Magenta Coupler

ExY: Yellow Coupler

ExS: Sensitizing Dye

UV: Ultraviolet Absorber

HBS: High Boiling Point Organic Solvent

H: Hardening Agent for Gelatin

The numeral corresponding to each component indicates the coated weight in unit of $g/m^2$, and the coated weight of silver halide is shown as the calculated weight of silver. Further, in the case of a sensitizing dye, the coated weight is indicated in unit of mol per mol of silver halide in the same layer.

Sample No. 101

| | |
|---|---|
| First Layer: First Antihalation Layer | |
| Black Colloidal Silver | 0.08 as silver |
| Gelatin | 0.70 |
| Second Layer: Second Antihalation Layer | |
| Black Colloidal Silver | 0.09 as silver |
| Gelatin | 1.00 |
| ExM-1 | 0.07 |
| ExM-8 | 0.05 |
| ExF-1 | $2.0 \times 10^{-3}$ |
| Solid Dispersion Dye ExF-2 | 0.030 |
| Solid Dispersion Dye ExF-3 | 0.040 |
| HBS-1 | 0.15 |
| HBS-2 | 0.02 |
| Third Layer: Interlayer | |
| Silver Iodobromide Emulsion N | 0.06 as silver |
| ExC-2 | 0.05 |
| Polyethyl Acrylate Latex | 0.20 |
| Gelatin | 0.70 |
| Fourth Layer: Low Sensitivity Red-Sensitive Emulsion Layer | |
| Silver Iodobromide Emulsion A | 0.07 as silver |
| Silver Iodobromide Emulsion B | 0.28 as silver |
| ExS-1 | $3.3 \times 10^{-4}$ |
| ExS-2 | $1.4 \times 10^{-5}$ |
| ExS-3 | $4.6 \times 10^{-4}$ |
| ExC-1 | 0.17 |
| ExC-3 | 0.030 |
| ExC-4 | 0.08 |
| ExC-5 | 0.020 |
| ExC-6 | 0.010 |
| ExC-9 | $2 \times 10^{-3}$ |
| ExC-11 | 0.02 |
| Cpd-2 | 0.025 |
| HBS-1 | 0.10 |
| Gelatin | 1.10 |
| Fifth Layer: Middle Sensitivity Red-Sensitive Emulsion Layer | |
| Silver Iodobromide Emulsion C | 0.70 as silver |
| ExS-1 | $4.2 \times 10^{-4}$ |
| ExS-2 | $1.8 \times 10^{-5}$ |
| ExS-3 | $5.9 \times 10^{-4}$ |
| ExC-1 | 0.12 |
| ExC-2 | 0.04 |

-continued

| | |
|---|---|
| ExC-3 | 0.05 |
| ExC-4 | 0.05 |
| ExC-5 | 0.02 |
| ExC-6 | 0.01 |
| ExC-9 | $5 \times 10^{-3}$ |
| ExC-11 | 0.03 |
| Cpd-4 | 0.02 |
| Cpd-2 | 0.02 |
| HBS-1 | 0.10 |
| Gelatin | 0.80 |
| Sixth Layer: High Sensitivity Red-Sensitive Emulsion Layer | |
| Silver Iodobromide Emulsion D | 0.90 as silver |
| ExS-1 | $3.5 \times 10^{-4}$ |
| ExS-2 | $1.5 \times 10^{-5}$ |
| ExS-3 | $4.9 \times 10^{-4}$ |
| ExC-1 | 0.05 |
| ExC-3 | 0.03 |
| ExC-6 | 0.020 |
| ExC-7 | 0.010 |
| Cpd-2 | 0.040 |
| Cpd-4 | 0.040 |
| HBS-1 | 0.22 |
| HBS-2 | 0.050 |
| Gelatin | 1.10 |
| Seventh Layer: Interlayer | |
| Cpd-1 | 0.060 |
| Solid Dispersion Dye ExF-4 | 0.030 |
| HBS-1 | 0.040 |
| Polyethyl Acrylate Latex | 0.15 |
| Gelatin | 1.10 |
| Eighth Layer: Low Sensitivity Green-Sensitive Emulsion Layer | |
| Silver Iodobromide Emulsion E | 0.27 as silver |
| Silver Iodobromide Emulsion F | 0.22 as silver |
| Silver Iodobromide Emulsion G | 0.16 as silver |
| ExS-7 | $7.5 \times 10^{-4}$ |
| ExS-8 | $3.4 \times 10^{-4}$ |
| ExS-4 | $2.5 \times 10^{-5}$ |
| ExS-5 | $9.0 \times 10^{-5}$ |
| ExS-6 | $4.3 \times 10^{-4}$ |
| ExC-10 | $2 \times 10^{-3}$ |
| ExM-3 | 0.15 |
| ExM-4 | 0.05 |
| ExM-7 | 0.07 |
| ExM-8 | 0.02 |
| ExY-1 | 0.01 |
| ExY-6 | 0.0020 |
| HBS-1 | 0.30 |
| HBS-3 | 0.015 |
| Cpd-4 | 0.010 |
| Gelatin | 0.95 |
| Ninth Layer: Middle Sensitivity Green-Sensitive Emulsion Layer | |
| Silver Iodobromide Emulsion G | 0.45 as silver |
| Silver Iodobromide Emulsion H | 0.35 as silver |
| ExS-4 | $3.6 \times 10^{-5}$ |
| ExS-7 | $1.7 \times 10^{-4}$ |
| ExS-8 | $8.0 \times 10^{-4}$ |
| ExC-8 | 0.0020 |
| ExC-10 | 0.003 |
| ExM-3 | 0.153 |
| ExM-4 | 0.03 |
| ExM-7 | 0.04 |
| ExM-8 | 0.02 |
| ExY-1 | 0.015 |
| ExY-4 | 0.005 |
| ExY-6 | 0.002 |
| Cpd-4 | 0.015 |
| HBS-1 | 0.13 |
| HBS-3 | $4.4 \times 10^{-3}$ |
| Gelatin | 0.80 |

-continued

| Tenth Layer: High Sensitivity Green-Sensitive Emulsion Layer | |
|---|---|
| Silver Iodobromide Emulsion I | 1.40 as silver |
| ExS-4 | $6.3 \times 10^{-5}$ |
| ExS-7 | $1.7 \times 10^{-4}$ |
| ExS-8 | $7.8 \times 10^{-4}$ |
| ExC-6 | 0.01 |
| ExC-10 | 0.002 |
| ExM-4 | 0.005 |
| ExM-2 | 0.020 |
| ExM-5 | 0.001 |
| ExM-6 | 0.001 |
| ExM-3 | 0.02 |
| Cpd-3 | 0.001 |
| Cpd-4 | 0.040 |
| HBS-1 | 0.25 |
| Polyethyl Acrylate Latex | 0.15 |
| Gelatin | 1.33 |
| Eleventh Layer: Yellow Filter Layer | |
| Yellow Colloidal Silver | 0.015 as silver |
| Cpd-1 | 0.16 |
| Solid Dispersion Dye ExF-5 | 0.060 |
| Solid Dispersion Dye ExF-6 | 0.060 |
| Oil-Soluble Dye ExF-7 | 0.010 |
| HBS-1 | 0.60 |
| Gelatin | 0.60 |
| Twelfth Layer: Low Sensitivity Blue-Sensitive Emulsion Layer | |
| Silver Iodobromide Emulsion J | 0.07 as silver |
| Silver Iodobromide Emulsion K | 0.13 as silver |
| Silver Iodobromide Emulsion L | 0.19 as silver |
| ExS-9 | $8.4 \times 10^{-4}$ |
| ExC-1 | 0.025 |
| ExC-8 | $7.0 \times 10^{-3}$ |
| ExC-9 | $5.0 \times 10^{-3}$ |
| ExY-1 | 0.060 |
| ExY-2 | 0.55 |
| ExY-3 | 0.40 |
| ExY-4 | 0.040 |
| ExY-5 | 0.25 |
| Cpd-2 | 0.005 |
| Cpd-4 | 0.005 |
| Cpd-3 | 0.004 |
| HBS-1 | 0.28 |
| Gelatin | 2.60 |

-continued

| Thirteenth Layer: High Sensitivity Blue-Sensitive Emulsion Layer | |
|---|---|
| Silver Iodobromide Emulsion M | 0.37 as silver |
| ExS-9 | $6.0 \times 10^{-4}$ |
| ExC-10 | 0.002 |
| ExY-2 | 0.070 |
| ExY-3 | 0.020 |
| ExY-4 | 0.0050 |
| Cpd-2 | 0.10 |
| Cpd-3 | $1.0 \times 10^{-3}$ |
| Cpd-4 | $5.0 \times 10^{-3}$ |
| HBS-1 | 0.075 |
| Gelatin | 0.55 |
| Fourteenth Layer: First Protective Layer | |
| Silver Iodobromide Emulsion N | 0.10 as silver |
| UV-1 | 0.13 |
| UV-2 | 0.10 |
| UV-3 | 0.16 |
| UV-4 | 0.025 |
| ExF-8 | 0.03 |
| ExF-9 | 0.005 |
| ExF-10 | 0.005 |
| ExF-11 | 0.02 |
| HBS-1 | $5.0 \times 10^{-2}$ |
| HBS-4 | $5.0 \times 10^{-2}$ |
| Gelatin | 1.8 |
| Fifteenth Layer: Second Protective Layer | |
| H-1 | 0.40 |
| B-1 (diameter: 1.7 μm) | 0.04 |
| B-2 (diameter: 1.7 μm) | 0.09 |
| B-3 | 0.13 |
| ES-1 | 0.20 |
| Gelatin | 0.70 |

Further, W-1 to W-4, B-4 to B-6, F-1 to F-18, iron salt, lead salt, gold salt, platinum salt, palladium salt, iridium salt and rhodium salt were appropriately included in each layer to improve storage stability, processing properties, pressure resistance, fungicidal and biocidal properties, antistatic properties and coating properties.

TABLE 3

| Emulsion | Average AgI Content (%) | Average Grain Size, Equivalent-Sphere Diameter (μm) | Variation Coefficient of the Grain Size (%) | Projected Area, Equivalent-Circle Diameter (μm) | Diameter/Thickness Ratio | Tabularity |
|---|---|---|---|---|---|---|
| A | 3.7 | 0.37 | 13 | 0.43 | 2.3 | 12 |
| B | 3.7 | 0.43 | 19 | 0.58 | 3.2 | 18 |
| C | 5.0 | 0.55 | 20 | 0.86 | 6.2 | 45 |
| D | 5.4 | 0.66 | 23 | 1.10 | 7.0 | 45 |
| E | 3.7 | 0.37 | 13 | 0.43 | 2.3 | 12 |
| F | 3.7 | 0.43 | 19 | 0.58 | 3.2 | 18 |
| G | 5.4 | 0.55 | 20 | 0.86 | 6.2 | 45 |
| H | 5.4 | 0.66 | 23 | 1.10 | 7.0 | 45 |
| I | 5.4 | 0.72 | 23 | 1.10 | 6.3 | 36 |
| J | 3.7 | 0.37 | 19 | 0.55 | 4.6 | 38 |
| K | 3.7 | 0.37 | 19 | 0.55 | 4.6 | 38 |
| L | 8.8 | 0.64 | 23 | 0.85 | 5.2 | 32 |
| M | 6.8 | 0.88 | 30 | 1.12 | 4.7 | 20 |
| N | 1.0 | 0.07 | — | — | 1.0 | — |

In Table 3

(1) Emulsions J to M were reduction sensitized during preparation of the grains using thiourea dioxide and thiosulfonic acid according to the examples of JP-A-2-191938 (corresponding to U.S. Pat. No. 5,061,614).

(2) Emulsions C to E, G to I and M were gold, sulfur, and selenium sensitized, respectively, in the presence of the spectral sensitizing dyes which are described at each light-sensitive layer and sodium thiocyanate according to the examples of JP-A-3-237450 (corresponding to EP-A-443453).

(3) Low molecular weight gelatin was used in the preparation of the tabular grains according to the examples of JP-A-1-158426.

(4) In tabular grains, there were observed such dislocation lines as disclosed in JP-A-3-237450 (corresponding to EP-A-443453), using a high pressure electron microscope.

(5) Emulsions A to E, G, H, and J to M contained optimal amounts of Rh, Ir and Fe.

(6) Emulsion F was gold and sulfur sensitized.

Further, tabularity is defined by $Dc/t^2$, taking the average equivalent-circle diameter in the projected area of tabular grains as Dc and the average thickness of tabular grains as t.

Preparation of Dispersion of Organic Solid Dispersion Dye

ExF-2 shown below was dispersed according to the following method. That is, 21.7 ml of water, 3 ml of a 5% aqueous solution of sodium p-octylphenoxyethoxyethoxyethanesulfonate, and 0.5 g of a 5% aqueous solution of p-octylphenoxypolyoxyethylene ether (polymerization degree: 10) were put in a pot mill having a capacity of 700 ml, and 5.0 g of Dye ExF-2 and 500 ml of zirconium oxide beads (diameter: 1 mm) were added thereto and the content was dispersed for 2 hours. The dispersion was performed using a BO-type vibrating ball mill manufactured by Chuo Koki K.K. The content was taken out after dispersion and added to 8 g of a 12.5% aqueous solution of gelatin and the beads were removed by filtration and the gelatin dispersion of the dye was obtained. The average particle size of fine particles of the dye was 0.44 μm.

Solid dispersions of ExF-3, ExF-4 and ExF-6 were obtained in the same manner. The average particle sizes of fine particles of the dyes were 0.24 μm, 0.45 μm and 0.52 μm, respectively. ExF-5 was dispersed according to the microprecipitation dispersion method disclosed in Working Example 1 of EP-A-549489. The average particle size was 0.06 μm.

ExC-1

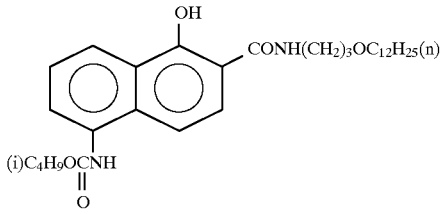

ExC-2

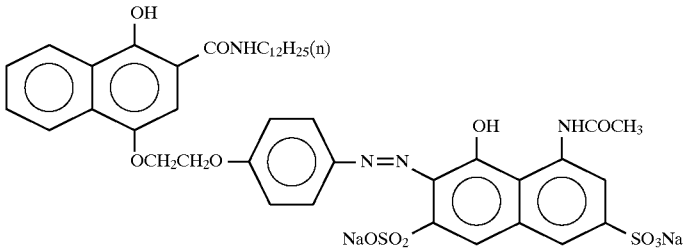

ExC-3

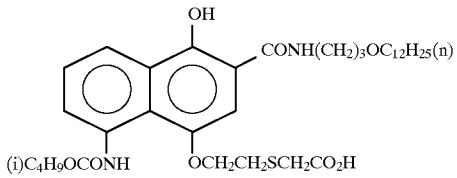

ExC-4

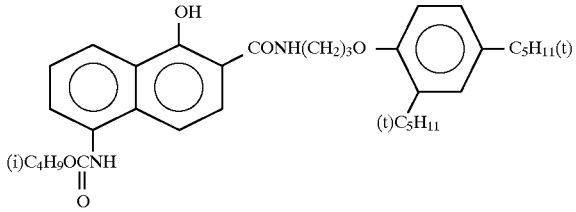

-continued
ExC-5
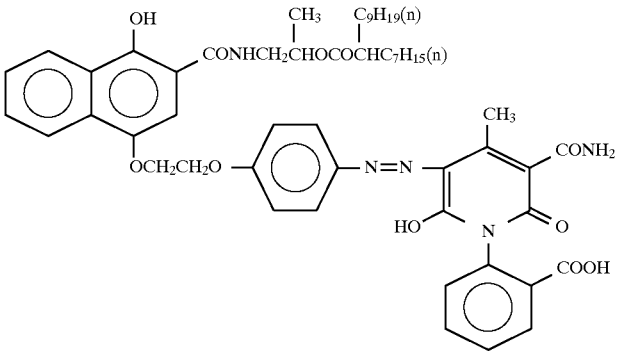
ExC-6
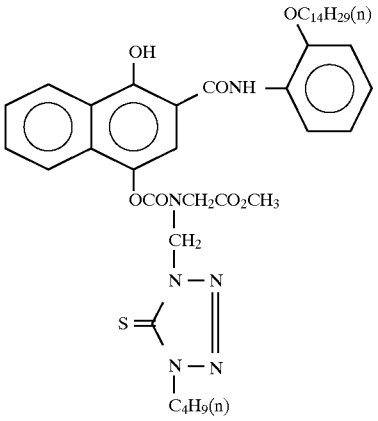
ExC-7
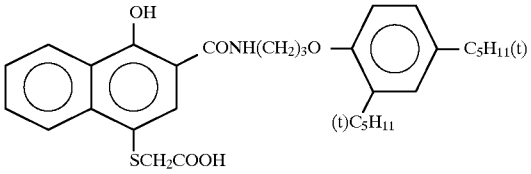
ExC-8
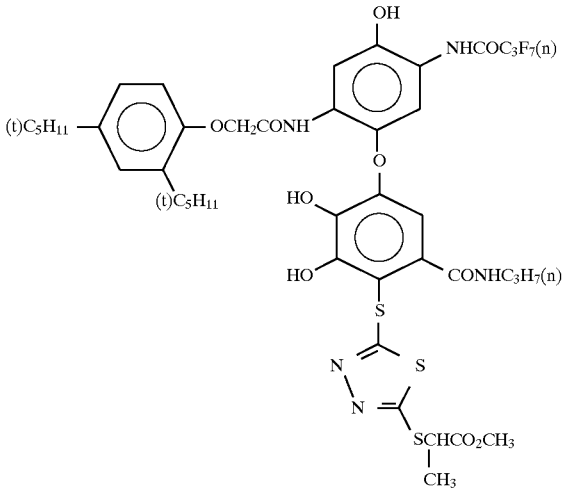

-continued
ExM-1
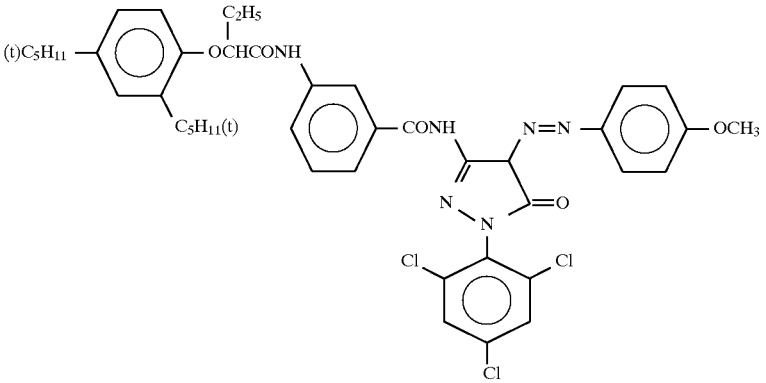
ExM-2
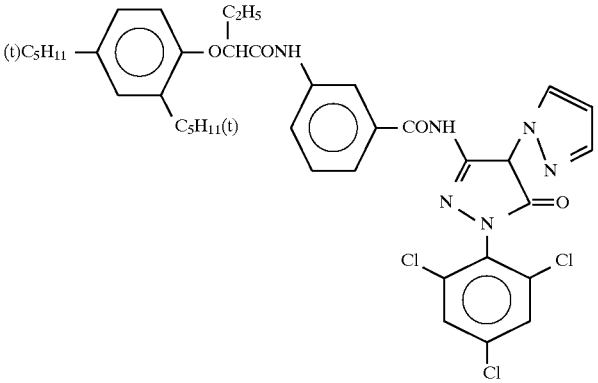
ExM-3
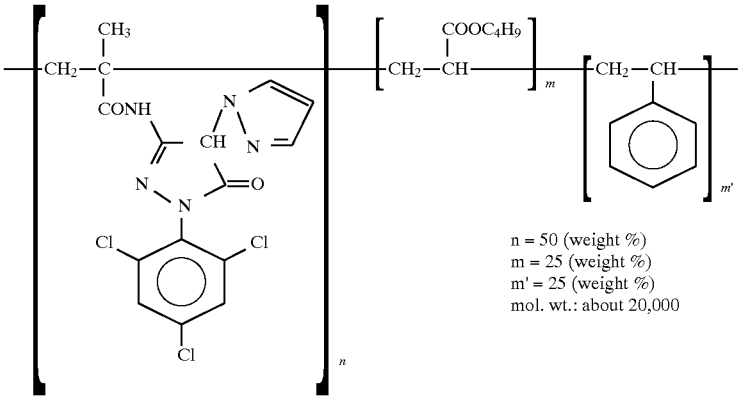
n = 50 (weight %)
m = 25 (weight %)
m' = 25 (weight %)
mol. wt.: about 20,000
ExM-4
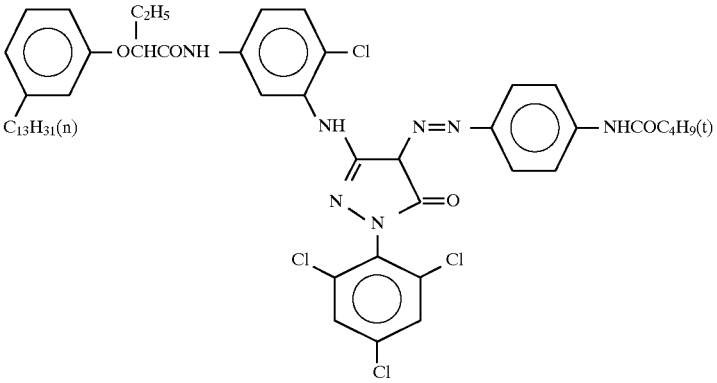

-continued
ExM-5
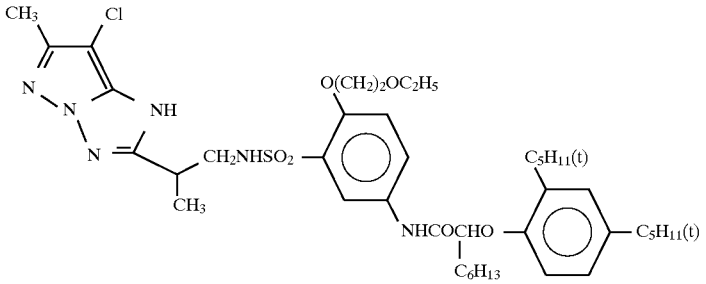
ExM-6
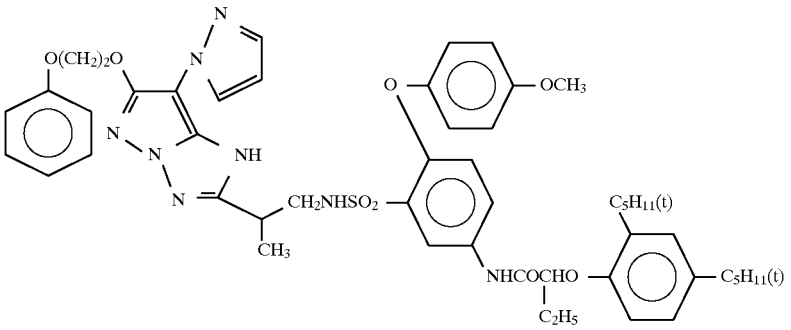
ExY-1
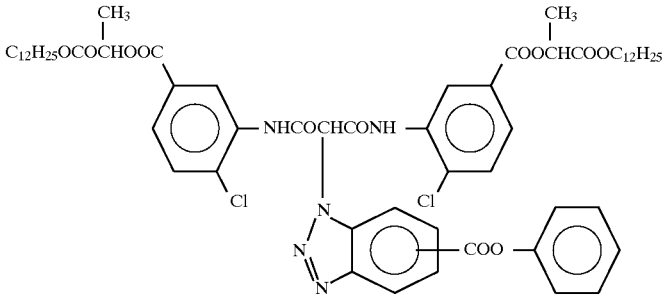
ExY-2
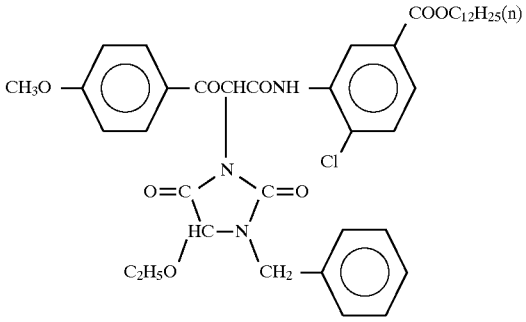
ExY-3
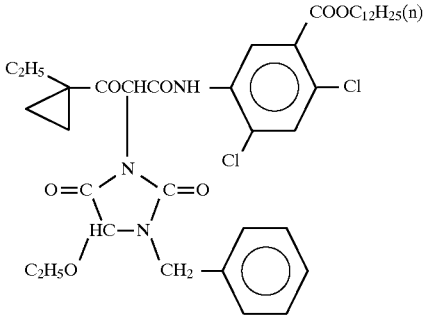

-continued
ExY-4
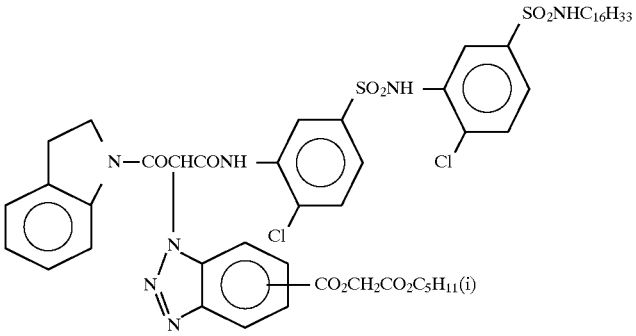
ExC-9
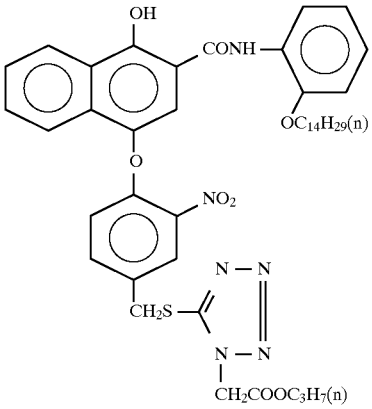
ExC-10
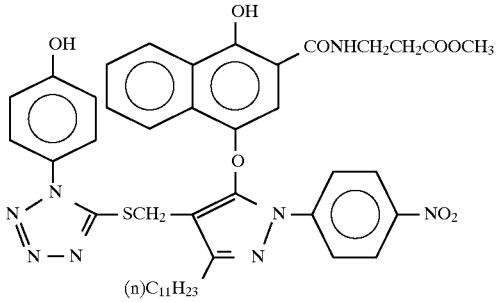
ExC-11
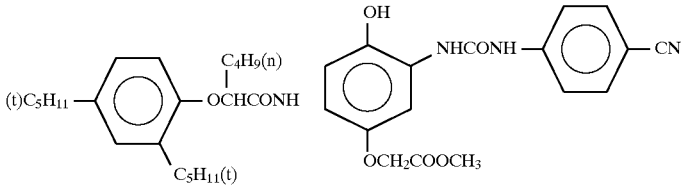
ExM-7
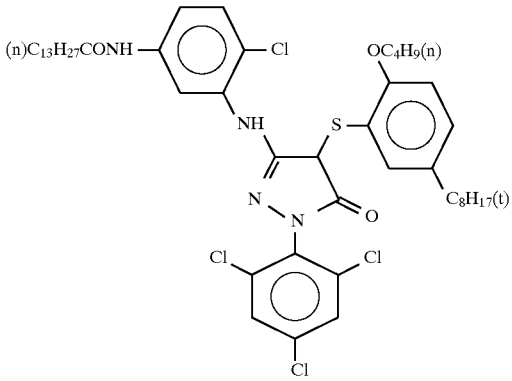

-continued
ExM-8
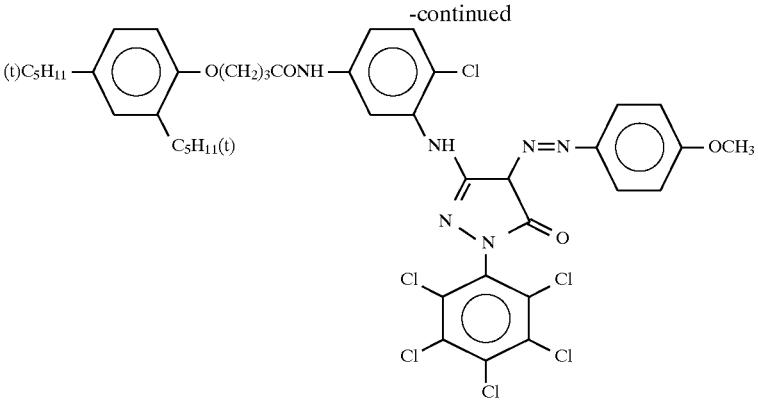
ExY-5
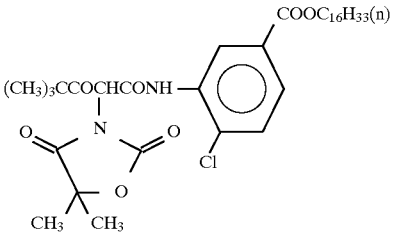
ExY-6
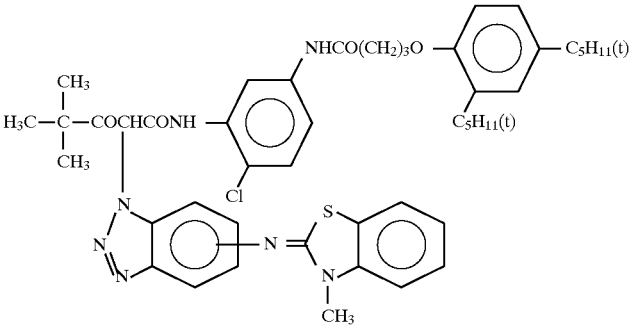
ExF-1
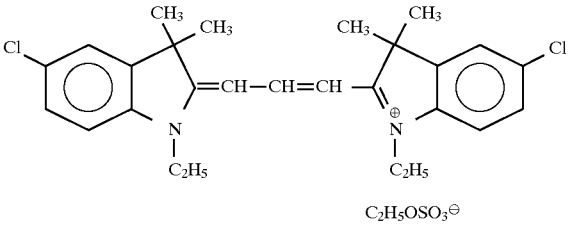
ExF-2
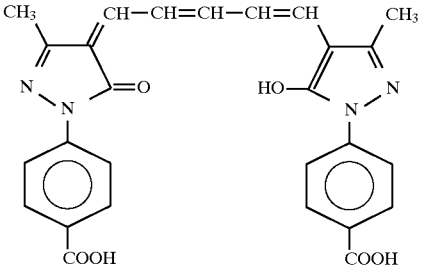
ExF-3
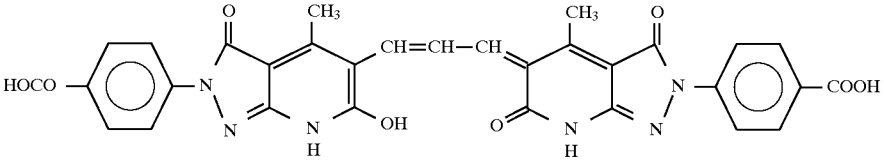

-continued
ExF-4
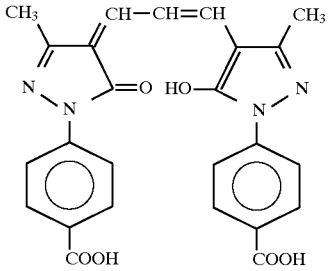
ExF-5
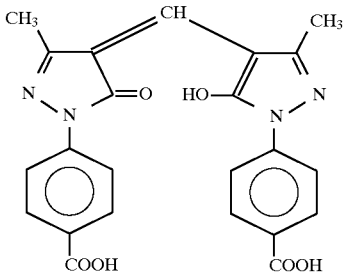
ExF-6
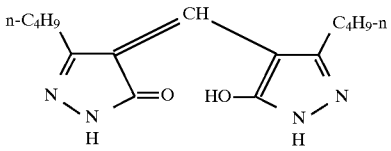
ExF-7
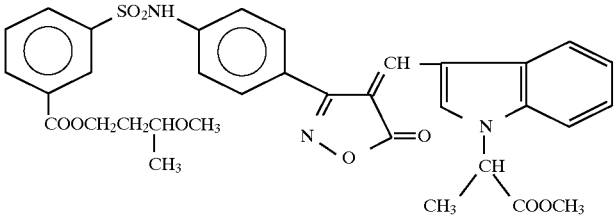
ExF-8
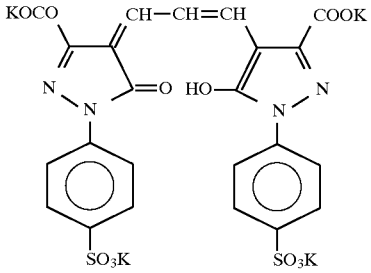
ExF-9
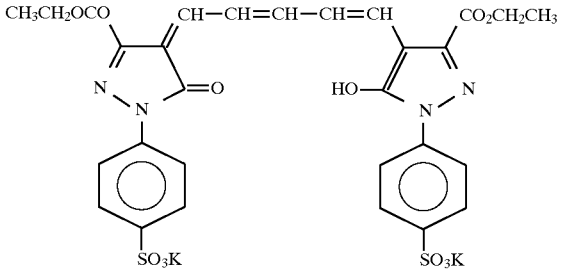

-continued
ExF-10
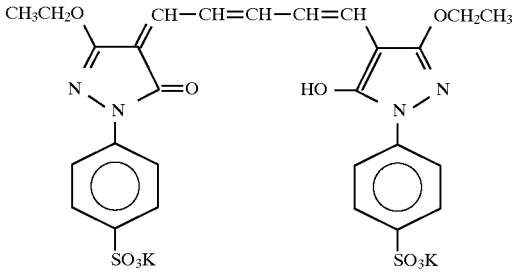
ExF-11
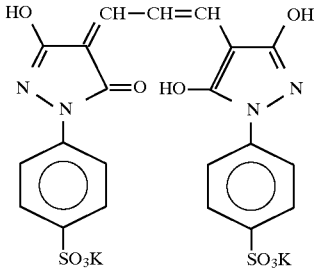
Cpd-1
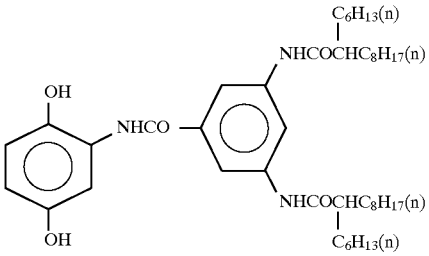
Cpd-2
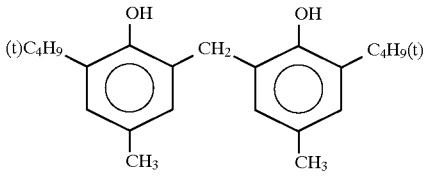
Cpd-3
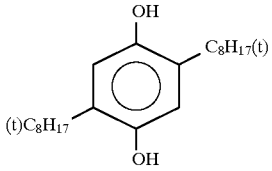
Cpd-4
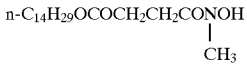
UV-1
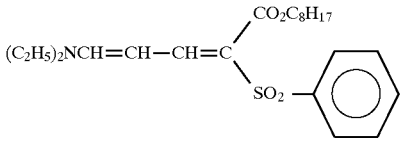
UV-2
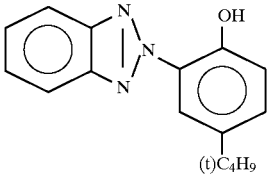

-continued
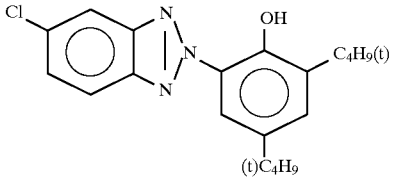
UV-4
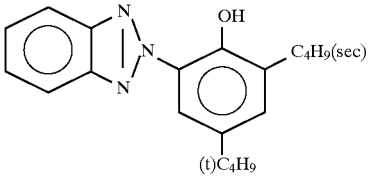
UV-3
Tricresyl Phosphate HBS-1
Di-n-butyl Phthalate HBS-2
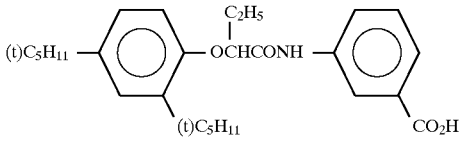
HSB-3
Tri(2-ethylhexyl) Phosphate HBS-4
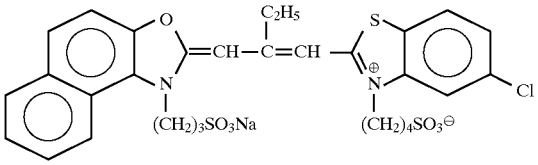
ExS-1
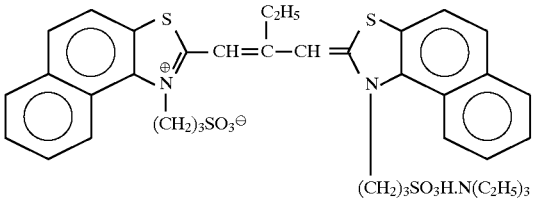
ExS-2
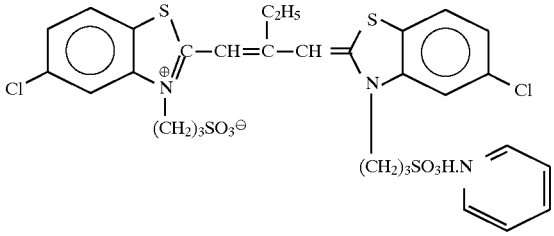
ExS-3
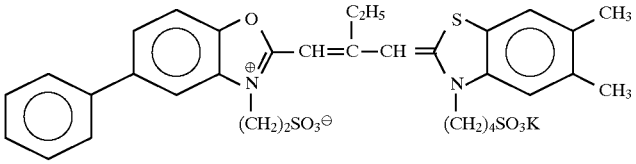
ExS-4
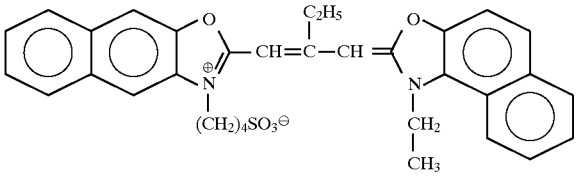
ExS-5

-continued
ExS-6
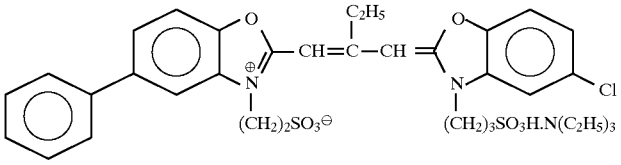
ExS-7
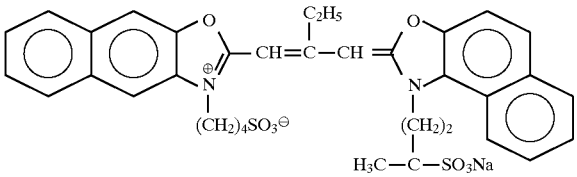
ExS-8
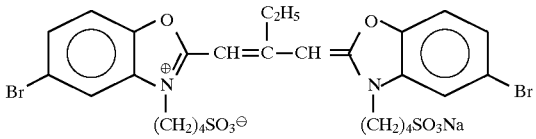
ExS-9
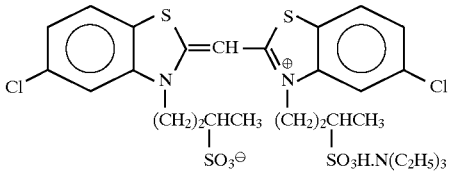
ES-1
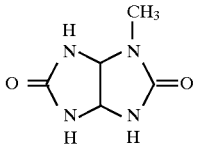
H-1
$CH_2{=}CH{-}SO_2{-}CH_2{-}CONH{-}CH_2$
$CH_2{=}CH{-}SO_2{-}CH_2{-}ONH{-}CH_2$
B-1
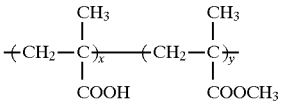
x/y = 10/90 (weight ratio)
average molecular weight:
about 35,000
B-2
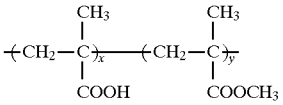
x/y = 45/55 (weight ratio)
average molecular weight:
about 20,000
B-3
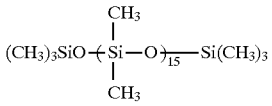
B-4
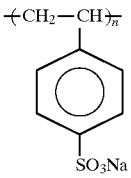
average molecular weight:
about 750,000
n = an integer
B-5
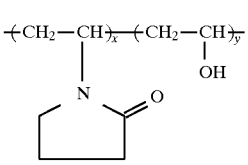
x/y = 70/30 (weight ratio)
average molecular weight:
about 17,000

-continued
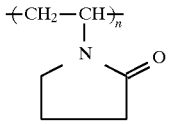
avergae molecular weight: about 10,000
n = an integer
B-6
$C_8F_{17}SO_2NHCH_2CH_2CH_2OCH_2CH_2\overset{\oplus}{N}(CH_3)_3$
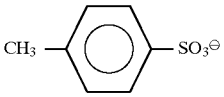
W-1
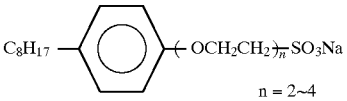
n = 2~4
W-2
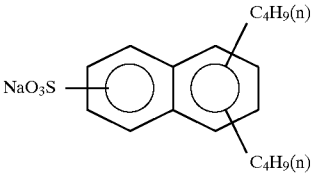
W-3
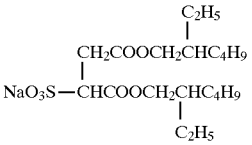
W-4
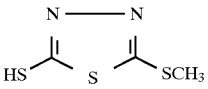
F-1
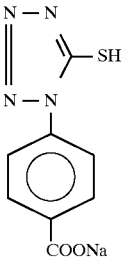
F-2
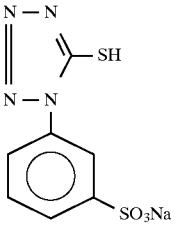
F-3
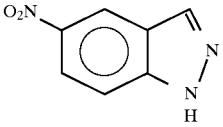
F-4
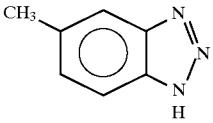
F-5

-continued
F-6
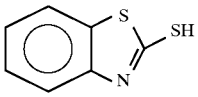
F-7
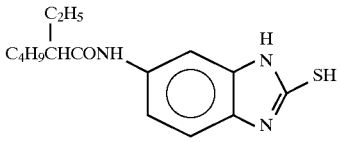
F-8
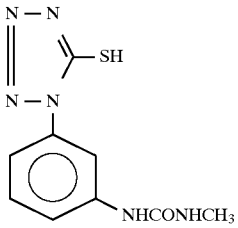
F-9
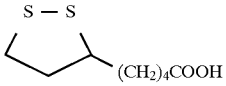
F-10
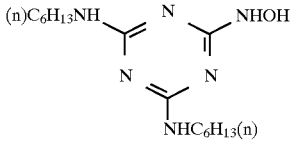
F-11
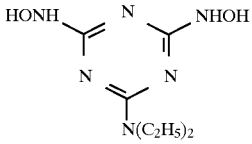
F-12
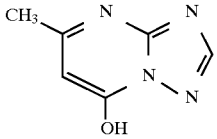
F-13
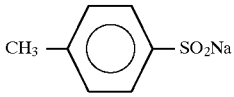
F-14
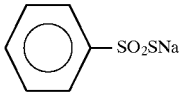
F-15
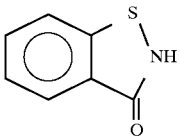
F-16
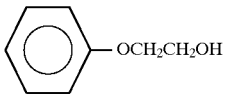
F-17
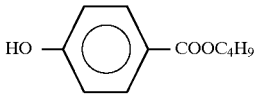

-continued

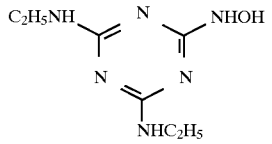

F-18

Each of the thus-prepared photographic materials was stored for three days under conditions of 35° C., 65% relative humidity, cut to the width of 24 mm, then the same perforations as those of NEXIA film (a trade name, produced by Fuji Photo Film Co., Ltd.) were provided on one side in the lengthwise direction of the material, and processed to a roll film of 40 exposures. This film was encased in a film cartridge to be loaded in EPION series camera (a name of the product of Fuji Photo Film Co., Ltd.).

Evaluation was conducted on the film encased in a film cartridge as follows.

(1) Magnetic Information Read Error

The above cartridge was loaded in EPION 300Z camera, the taking picture plane size was designated as a panoramic size, the film was set to record a date and photographing was conducted. Photographing was carried out using at least one hundred rolls of films per one sample. After photographing, these samples were subjected to color development processing as described below and one hundred rolls of films per one sample were printed using a print processor PP1827V (a product of Fuji Photo Film Co., Ltd.). The number of magnetic information read errors at the time when 4,000 frames per one sample were printed was counted.

(2) Adhesion of Dusts and Chips

Further, after one hundred rolls of films per one sample were printed using a print processor PP1827V, the adhesion of dusts and chips onto the magnetic head part of a negative film carrier NC-240S was observed using a microscope and the correlation of the adhesion with the number of errors was also examined.

The negative film carrier NC-240S was replaced with new one every one hundred rolls of films of one sample were color development processed and printed.

The evaluation of the adhesion of dusts and chips was conducted by observation with a microscope and classified into the following five grades.

1: Adhesion of dusts and chips was not or hardly observed.

2: A trace of adhesion was observed.

3: Observed.

4: Fairly observed.

5: Conspicuous adhesion was observed.

Color development processing used in the present invention is shown below.

In the first place, each sample photographed with a camera was processed as shown below by 1 $m^2$ in total per one day for 15 days.

Each processing was conducted using an automatic processor FP-922 manufactured by Fuji Photo Film Co., Ltd. according to the following step.

The processing step and the composition of each processing solution are shown below.

Processing Step

| Step | Processing Time | Processing Temperature (°C.) | Replenishment Rate* (ml) | Tank Capacity (liter) |
|---|---|---|---|---|
| Color Development | 3 min 5 sec | 38.0 | 20 | 17 |
| Bleaching | 50 sec | 38.0 | 5 | 5 |
| Fixing (1) | 50 sec | 38.0 | — | 5 |
| Fixing (2) | 50 sec | 38.0 | 8 | 5 |
| Washing | 30 sec | 38.0 | 17 | 3.5 |
| Stabilization (1) | 20 sec | 38.0 | — | 3 |
| Stabilization (2) | 20 sec | 38.0 | 15 | 3 |
| Drying | 1 min 30 sec | 60 | | |

*Replenishing rate: per 385 $cm^2$ of the photographic material

Stabilization was conducted in a countercurrent system from (2) to (1), and the overflow from the washing tank was all introduced into the fixing tank (2). Fixation was also conducted in a countercurrent system and fixing tanks were connected by countercurrent piping from (2) to (1). Further, the amount of the carryover of the developing solution into the bleaching step, the amount of the carryover of the bleaching solution to the fixing step, and the amount of the carryover of the fixing solution to the washing step were 2.5 ml, 2.0 ml and 2.0 ml per 385 $cm^2$ of the photographic material, respectively. Further, the crossover time was 6 seconds in each case, and this time is included in the processing time of the previous step.

The composition of each processing solution is described below.

| | Tank Solution (g) | Replenisher (g) |
|---|---|---|
| Color Developing Solution | | |
| Diethylenetriaminepentaacetic Acid | 2.0 | 2.0 |
| 1-Hydroxyethylidene-1,1-diphosphonic Acid | 2.0 | 2.0 |
| Sodium Sulfite | 3.9 | 5.3 |
| Potassium Carbonate | 37.5 | 39.0 |
| Potassium Bromide | 1.4 | 0.4 |
| Potassium Iodide | 1.3 mg | — |
| Disodium N,N-Bis(sulfonatoethyl)hydroxylamine | 2.0 | 2.0 |
| Hydroxylamine Sulfate | 2.4 | 3.3 |
| 2-Methyl-4-[N-ethyl-N-(β-hydroxyethyl)amino]aniline Sulfate | 4.5 | 6.4 |
| Water to make | 1.0 l | 1.0 l |
| pH (adjusted with potassium hydroxide and sulfuric acid) | 10.05 | 10.18 |
| Bleaching Solution | | |
| Ammonium 1,3-Diaminopropanetetraacetato Ferrate Monohydrate | 118 | 180 |
| Ammonium Bromide | 80 | 115 |
| Ammonium Nitrate | 14 | 21 |

-continued

| | Tank Solution (g) | Replenisher (g) |
|---|---|---|
| Succinic Acid | 40 | 60 |
| Maleic Acid | 33 | 50 |
| Water to make | 1.0 l | 1.0 l |
| pH (adjusted with aqueous ammonia) | 4.4 | 4.0 |
| Fixing Solution | | |
| Ammonium Methanesulfinate | 10 | 30 |
| Ammonium Methanethiosulfonate | 4 | 12 |
| Aqueous Ammonium Thiosulfate Solution (700 g/liter) | 280 ml | 840 ml |
| Imidazole | 7 | 20 |
| Ethylenediaminetetraacetic Acid | 15 | 45 |
| water to make | 1.0 l | 1.0 l |
| pH (adjusted with aqueous ammonia and acetic acid) | 7.4 | 7.45 |

Washing Water

City water was passed through a mixed bed column packed with an H-type strongly acidic cation exchange resin (Amberlite IR-120B of Rohm & Haas) and an OH-type strongly basic anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 150 mg/liter of sodium sulfate were added thereto. The pH of this washing water was in the range of from 6.5 to 7.5.

Stabilizing Solution (replenisher equals tank solution)

| | (unit: g) |
|---|---|
| Sodium p-Toluenesulfinate | 0.03 |
| Polyoxyethylene-p-monononylphenyl Ether (average polymerization degree: 10) | 0.2 |
| Disodium Ethylenediaminetetraacetate | 0.05 |
| 1,2,4-Triazole | 1.3 |
| 1,4-Bis(1,2,4-triazol-1-ylmethyl)-piperazine | 0.75 |
| 1,2-Benzisothiazolin-3-one | 0.10 |
| Water to make | 1.0 l |
| pH | 8.5 |

Ten (10) ml of the fixing replenisher was added to the above stabilizing solution.

The stabilizing solution added with 10 ml of the fixing replenisher was used as a stabilizing solution intending the most deteriorated color development processing. This stabilizing solution supposes the case in which a fixing solution is carried over to a stabilizing solution without being removed completely by washing, which is possible to happen.

The results obtained are shown in Tables 1 and 2 above.

From the above tables it can be understood that Samples Nos. 102 to 111 and 113 to 141, which satisfy the constitution of the present invention of the weight ratio of the sliding agent/binder of the farthest layer from the support of the backing layers of the photographic material being from 1 to $1\times10^4$, showed apparently few or no read error of magnetic information, showed a good sliding property, and the adhesion of dusts and chips of the processed material, etc., to the magnetic head part was less as compared with comparative samples. However, traces of adhesion were observed in Sample No. 136, although the adhered area was small. Further, the same adhesion was also observed in Sample No. 141, although the degree was still smaller. From the above fact, it is presumed that adhesion is caused due to a large coating amount of a sliding agent even if the weight ratio of the sliding agent/binder satisfies the constitution of the present invention, therefore, it is preferred to avoid the use of a large amount of a sliding agent.

Moreover, the comparative sample using Support No. 101 which is out of the range of the present invention showed a great many of magnetic information read errors and an inferior sliding property and adhesion of dusts and chips was conspicuous, although deteriorated color development processing was conducted intendedly. Accordingly, it can be understood that the weight ratio of the sliding agent/binder of 1 or more is essential to solve the object of the present invention. Further, in the comparative sample of Support No. 112 which is out of the range of the present invention, magnetic information read error was few and showed good results with respect to a sliding property and adhesion of dusts and chips, but adhesion having a larger adhered area than that of the above Sample No. 136 was generated and since the degree thereof was such that it impaired the surface state of the light-sensitive layer, it was unpracticable in spite of the results in Table 2.

It can be seen from Sample Nos. 133 to 136 and 137 to 141 that amounts of both a sliding agent and a binder used are preferably within the above-described preferred range even if the weight ratio of the sliding agent/binder satisfies the constitution of the present invention.

In addition, in the observation of the adhesion of dusts, etc., to the magnetic head part of the negative film carrier NC-240S, the adhesion to the head gap part was hardly observed in grade 2, but the adhesion was observed in a wide range from the space loss part to the head gap part as the grade proceeds from 3 to 5, and the more the adhesion to the head gap part, the larger is the error number.

EXAMPLE 2

Each light-sensitive layer having the following composition was coated on the opposite side of the backing layer of each of Support Nos. 101 to 141 prepared in Example 1 and Sample Nos. 201 to 241 were prepared.

Coating of Light-Sensitive Emulsion layer

The following emulsions were prepared.

Preparation of Emulsion A

One (1) liter of water containing 25 g of potassium bromide, 15 g of potassium iodide, 1.9 g of potassium thiocyanate and 24 g of gelatin was put in a vessel and the temperature of the vessel was maintained at 60° C., and an aqueous solution of silver nitrate and an aqueous solution of potassium bromide were added thereto by a double jet method with vigorously stirring according to an ordinary ammoniacal method to thereby obtain a comparatively amorphous and thick plate-like silver iodobromide emulsion having an iodide content of 10 mol % and an average grain size of 1.0 $\mu$m. The temperature was then lowered to 35° C. and soluble salts were removed by coagulating precipitation, then the temperature was raised to 40° C., 82 g of gelatin was added thereto, and the pH and pAg were adjusted to 6.40 and 8.80, respectively, with sodium hydroxide and sodium bromide.

After the temperature was raised to 61° C., 0.95 g of 2-phenoxyethanol was added thereto, and further 213 mg of Sensitizing Dye-A shown below was added. After 10 minutes, 1.2 mg of sodium thiosulfate pentahydrate, 28 mg of potassium thiocyanate and 0.4 mg of chloroauric acid were added, and after 65 minutes the emulsion was solidified by cooling quickly.

Sensitizing Dye-A

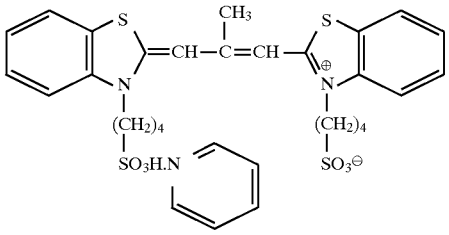

Preparation of Emulsion B

One (1) liter of water containing 25 g of potassium bromide, 9 g of potassium iodide, 7.6 g of potassium thiocyanate and 24 g of gelatin was put in a vessel and the temperature of the vessel was maintained at 40° C., and an aqueous solution of silver nitrate and an aqueous solution of potassium bromide were added thereto by a double jet method with vigorously stirring according to an ordinary ammoniacal method to thereby obtain a comparatively amorphous and thick plate-like silver iodobromide emulsion having an iodide content of 6 mol % and an average grain size of 0.6 μm. The temperature was then lowered to 35° C. and soluble salts were removed by precipitation, then the temperature was raised to 40° C., 110 g of gelatin was added thereto, and the pH and pAg were adjusted to 6.60 and 8.90, respectively, with sodium hydroxide and sodium bromide.

After the temperature was raised to 56° C., 0.8 mg of chloroauric acid, 9 mg of potassium thiocyanate and 4 mg of sodium thiosulfate were added thereto. After 55 minutes, 180 mg of Sensitizing Dye-A was added, and after 10 minutes, the emulsion was solidified by cooling quickly.

Each layer having the following composition was coated on the above-prepared undercoat layer opposite to the side on which backing layers were provided of each of Support Nos. 101 to 141 and photographic materials were prepared. These were designated Sample Nos. 201 to 241 corresponding to Support Nos. 101 to 141.

First Layer: Antihalation Layer

| | |
|---|---|
| Gelatin | 1.0 g/m$^2$ |
| Compound-II | 140 mg/m$^2$ |
| Compound-III | 15 mg/m$^2$ |
| Dye-I | 26 mg/m$^2$ |
| Dye-II | 16 mg/m$^2$ |

Compound-II

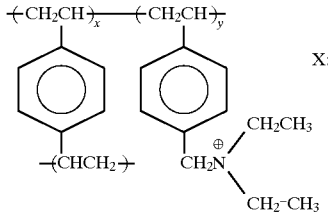

X:Y = 20:80 (weight ratio)

1/2 $SO_4^{2\ominus}$

Compound-III

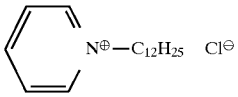

Dye-I

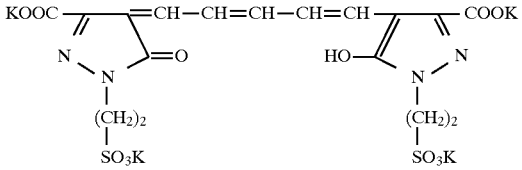

Dye-II

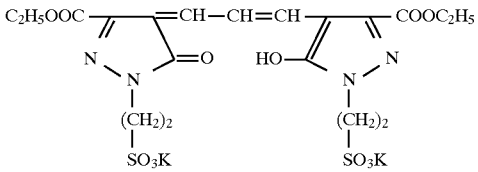

Second Layer: Interlayer

| | |
|---|---|
| Gelatin | 0.4 g/m$^2$ |
| Poly(potassium p-vinylbenzenesulfonate) | 5 mg/m$^2$ |

-continued

Third Layer: Emulsion Layer

| | |
|---|---|
| Emulsion B | 1.36 $g/m^2$ coated weight of silver |
| Gelatin | 2.0 $g/m^2$ |
| 4-Hydroxy-6-methyl-1,3,3a,7-tetraazaindene | 15 $mg/m^2$ |
| $C_{18}H_{35}O(CH_2CH_2O)_{25}H$ | 7 $mg/m^2$ |
| Compound-IV | 1.5 $mg/m^2$ |
| Poly(potassium p-vinylbenzenesulfonate) | 50 $mg/m^2$ |
| Hardening Agent | 37 $mg/m^2$ |

Compound-IV

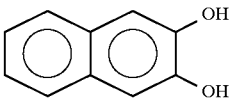

Hardening Agent

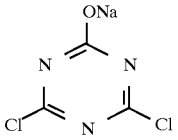

Fourth Layer: Emulsion Layer

| | |
|---|---|
| Emulsion A | 4.2 $g/m^2$ coated weight of silver |
| Gelatin | 5.5 $g/m^2$ |
| Dextran (average molecular weight: 150,000) | 1.8 $g/m^2$ |
| 4-Hydroxy-6-methyl-1,3,3a,7-tetraazaindene | 41 $mg/m^2$ |
| $C_{18}H_{35}O(CH_2CH_2O)_{25}H$ | 23 $mg/m^2$ |
| Trimethylolpropane | 390 $mg/m^2$ |
| Poly(potassium p-vinylbenzenesulfonate) | 88 $mg/m^2$ |
| Polyacrylic Acid | 54 $mg/m^2$ |

Fifth Layer: Surface Protective Layer

| | |
|---|---|
| Gelatin | 0.8 $g/m^2$ |
| Compound-V | 13 $mg/m^2$ |
| Compound-VI | 50 $mg/m^2$ |
| Compound-VII | 1.8 $mg/m^2$ |
| Poly(potassium p-vinylbenzenesulfonate) | 6 $mg/m^2$ |
| Polymethyl Methacrylate Fine Particles (average particle size: 3 $\mu$m) | 24 $mg/m^2$ |
| Compound-VIII | 50 $mg/m^2$ |

Compound-V

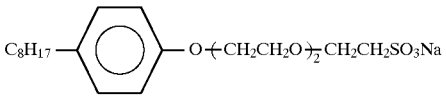

Compound-VI

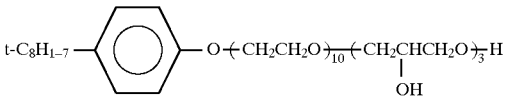

Compound-VII

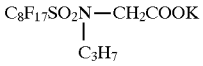

Compound-VIII (Compound (5))
$C_{15}H_{31}COOC_{40}H_{81}(n)$

Each of the thus-prepared photographic materials was stored for 14 days under conditions of 30° C., 65% relative humidity, cut and processed as in Example 1 and the same evaluation was conducted.

The following development processing was carried out instead of color development processing used in Example 1.

Developing conditions were as follows.

| | Processing Solution | Temperature (°C.) | Time (sec) |
|---|---|---|---|
| Development | HPD | 26.5 | 55 |
| Fixing | Super Fujix DP2 | 26.5 | 76 |
| Washing | running water | 20 | 95 |
| Drying | | 50 | 69 |

HPD and Super Fujix DP2 were trade names of the products of Fuji Photo Film Co., Ltd.

The results obtained showed the similar inclination as the results shown in Tables 1 and 2 in Example 1. It was confirmed that the samples satisfying the constitutional requirements of the present invention, in particular, when the coating amounts of a sliding agent and a binder were within the preferred range, could superbly achieve the object of the present invention.

EXAMPLE 3

Support Nos. 301 to 341 having the same constitutions as Support Nos. 101 to 141 were prepared in the same manner as the preparations of Support Nos. 101 to 141 except that the coating amount of cobalt-γ-iron oxide coating-treated with 3-polyoxyethylene-propyloxytrimethoxysilane in item 3-2) coating of magnetic recording layer in Example 1 was made half the amount (0.03 g/m$^2$). The increment of color density $D^B$ of the magnetic recording layer was about 0.05.

Sample Nos. 301 to 341 were prepared by coating the same nineteen photographic constitutional layers having silver halide light-sensitive layers as Sample No. 110 disclosed in Example 1 of JP-A-7-225459 on the undercoat layer on the opposite side of the support on which backing layers were provided of each of Support Nos. 101 to 141.

Each of these samples was cut and processed as in Example 1 and encased in a film cartridge. The picture plane size was designated as a panoramic size, the film was set to record a date and photographing was conducted. Development processing was carried out using requisite steps of standard development processing and processing solutions disclosed in Example 1 of JP-A-7-225459.

One hundred rolls of films per one sample after being processed were printed using a print processor PP1827V used in Example 1. The films were designated to read out only the magnetic information and the number of magnetic information read errors at the time when 4,000 frames per one sample were printed was counted.

The results obtained showed the similar inclination as the results shown in Tables 1 and 2 in Example 1. However, samples with many errors in Tables 1 and 2 showed still more errors and numbers of errors were also increased with respect to those with fewer errors. These results are thought to be attributable to the fact that the coating amounts of the ferromagnetic particles are poor.

In addition, the results of the observation of the adhesion of dusts, chips, etc., were the same as those in Tables 1 and 2.

The present invention provides a silver halide photographic material having a magnetic recording function comprising a support having thereon photographic constitutional layers and a magnetic recording layer in backing layers on the opposite side of the support, which is invested with a sliding property, prevention of the adhesion of dusts and chips, etc., and reduction in errors at input and output head parts of magnetic information by the incorporation of a binder and a sliding agent in the layer farthest from the support of the backing layers with the weight ratio of the sliding agent/binder being from 1 to $1\times10^4$.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having provided thereon at least one light-sensitive silver halide emulsion layer and a magnetic recording layer in backing layers on the side of the support opposite to the side on which the silver halide emulsion layer is provided, wherein the layer on the farthest side from the support of said backing layers contains a binder and a sliding agent, wherein said binder is hydroxyalkyl cellulose, and the weight ratio of the sliding agent/binder is from 1 to $1\times10^4$.

2. The silver halide photographic material as claimed in claim 1, wherein said sliding agent is a higher fatty acid or a derivative thereof and is contained in an amount of 1 mg/m$^2$ or more.

3. The silver halide photographic material as claimed in claim 1, wherein the coating weight of the binder is from $1\times10^{-2}$ mg/m$^2$ to 20 mg/m$^2$.

4. The silver halide photographic material as claimed in claim 1, wherein said hydroxyalkyl cellulose is a cellulose derivative etherified with an alkyl group having a hydroxyl group and having from 2 to 6 carbon atoms.

5. The silver halide photographic material as claimed in claim 4, wherein said hydroxyalkyl cellulose is a hydroxyethyl cellulose derivative or a hydroxypropyl cellulose derivative.

6. The silver halide photographic material as claimed in claim 1, wherein said hydroxyalkyl cellulose has a molecular weight of from 10,000 to 1,500,000.

7. The silver halide photographic material as claimed in claim 1, wherein the weight ratio of the sliding agent/binder is from 3 to 1,000.

8. The silver halide photographic material as claimed in claim 1, wherein the weight ratio of the sliding agent/binder is from 5 to 500.

* * * * *